US006926458B2

(12) United States Patent
Maki et al.

(10) Patent No.: US 6,926,458 B2
(45) Date of Patent: Aug. 9, 2005

(54) BALL-POINT PEN REFILL

(75) Inventors: Takayuki Maki, Yokohama (JP); Kiyoshi Fujisawa, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 10/250,773

(22) PCT Filed: Dec. 28, 2001

(86) PCT No.: PCT/JP01/11644

§ 371 (c)(1),
(2), (4) Date: Jul. 9, 2003

(87) PCT Pub. No.: WO02/055317

PCT Pub. Date: Jul. 18, 2002

(65) Prior Publication Data

US 2004/0067092 A1 Apr. 8, 2004

(30) Foreign Application Priority Data

Jan. 10, 2001 (JP) ..... 2001-002319
Jan. 10, 2001 (JP) ..... 2001-002320
Jan. 10, 2001 (JP) ..... 2001-002321

(51) Int. Cl.[7] ..... B43K 7/10
(52) U.S. Cl. ..... 401/215; 401/188 A
(58) Field of Search ..... 401/141–143, 401/188 R, 188 A, 190, 209, 212, 214–217

(56) References Cited

U.S. PATENT DOCUMENTS 2,192,479 A * 3/1940 Nissen, Jr. ..... 401/141
2,606,529 A * 8/1952 Wagner ..... 401/141
2,871,824 A * 2/1959 Sams ..... 401/217
3,234,917 A * 2/1966 Harvey et al. ..... 401/142
3,656,857 A * 4/1972 Seregely ..... 401/142
3,659,951 A * 5/1972 Germann ..... 401/190
3,775,015 A * 11/1973 Tsunoda et al. ..... 401/141
4,139,424 A * 2/1979 Herrnring ..... 205/143
5,520,473 A * 5/1996 Durham ..... 401/216
6,082,920 A * 7/2000 Furukawa ..... 401/216
6,161,977 A * 12/2000 Furukawa ..... 401/209
6,361,234 B1 * 3/2002 Rukan et al. ..... 401/190
6,422,776 B1 * 7/2002 Nakatani ..... 401/216
6,443,647 B1 * 9/2002 Lerch et al. ..... 401/142
6,479,568 B1 * 11/2002 Fujii et al. ..... 523/161

FOREIGN PATENT DOCUMENTS

JP 47-48565 B1 12/1972
JP 57-134185 U 8/1982
JP 60-186574 A 9/1985
JP 61-85486 U 6/1986
JP 10-236065 A 9/1998
JP 10-278474 A 10/1998

* cited by examiner

*Primary Examiner*—Tuan Nguyen
(74) *Attorney, Agent, or Firm*—Kubovcik & Kubovcik

(57) ABSTRACT

For producing a pressurized ball-point pen refill the ball-point pen refill includes a tip, an ink storage tube and a tail plug, wherein ink is filled in the space of the ink storage tube relatively near to the tip, and a pressuring gas is filled in the space of the ink storage tube relatively far from the tip. The tip includes a ball and a holder, and the ball is formed to have a surface roughness (Ra) of 0.010 $\mu$m to 0.080 $\mu$m. The holder has a ball house and an ink guiding groove, and the ball house has a side part and a bottom part. Moreover, a formula $1.01 \leqq \phi B/\phi A \leqq 1.11$ is satisfied when $\phi A$ is the diameter of the ball, and $\phi B$ is the inner diameter of the side part of the ball house.

31 Claims, 5 Drawing Sheets

BALL-POINT PEN REFILL

TECHNICAL FIELD

The present invention relates to a ball-point pen refill and more particularly to a so-called pressurized ball-point pen refill in which pressuring gas is filled in an ink storage tube and ink is squeezed to flow toward a tip under the pressure of the pressuring gas.

BACKGROUND ART

A variety of types of ball-point pen refills have been provided.

For example, there is provided a so-called pressurized ball-point pen refill comprising an ink storage tube, a tip fixed to the ink storage tube at an end and a tail plug provided at an end of the storage tube opposite to the tip, wherein ink is filled in the space of the ink storage tube relatively near to the tip, and pressuring gas is filled in the space of the ink storage tube relatively far from the tip, the ink being squeezed to flow toward the tip under the pressure of the pressuring gas.

This pressurized ball-point pen refill enables writing even with the tip turned upward because the pressuring gas constantly squeezes the ink to flow toward the tip.

In the pressurized ball-point pen refill described above, however, there have been cases where the ink leaks from the leading end of the tip under the pressure of the pressuring gas. In addition, there have been cases where a ball drops out from a ball house under the pressure of the pressuring gas.

For preventing such problems, in the pressurized ball-point pen refill, the ball house is formed to have a small inner diameter relative to the diameter of the ball.

However, if the ball house is formed to have a small inner diameter relative to the diameter of the ball, the width of an ink passage in the vicinity of the leading end of the tip is reduced, and therefore problems such as faint lines and degradation in initial writing performance may arise.

In addition, for preventing the problems such as the faint lines and the degradation in initial writing performance while the ball house is formed to have a small inner diameter relative to the diameter of the ball, the ball is formed to have a relatively rough surface.

However, if the ball has an extremely rough surface, a ball seat becomes more prone to wear, and therefore durability of the tip may decline, resulting in a reduction in a writable distance.

That is, in the pressurized ball-point pen refill, it is very difficult to prevent ink leakage and ball dropout, to prevent also the faint lines and the degradation in the initial writing performance, and to increase the writable distance.

Moreover, in the pressurized ball-point pen refill described above, there have been cases where the pressure of the pressuring gas causes the ink to leak from the leading end of the tip.

For preventing the ink leakage, the ink is adjusted to have a relatively high viscosity in the pressurized ball-point pen refill.

However, if the ink is adjusted to have an extremely high viscosity, problems such that writability becomes heavy, that the faint lines tends to occur, and that the initial writing performance is degraded may arise.

On the other hand, if the ink is adjusted to have a low viscosity, the problems can be eliminated, but the ink may leak from the leading end of the tip.

For preventing the ink from leaking from the leading end of the tip, the pressuring gas is adjusted to have a relatively low pressure.

However, if the pressuring gas is adjusted to have an extremely low pressure, problems such that the faint lines tend to occur, and that the initial writing performance is degraded may arise. In addition, if the pressuring gas is adjusted to have an extremely low pressure, the pressure of the pressuring gas may decrease to an atmospheric pressure before the ink is fully used, resulting in that the pen cannot write while the ink remains in the ink storage tube. In other words, the writable distance may decrease.

On the other hand, if the pressuring gas is adjusted to have a high pressure, the problems can be eliminated, but the ink may leak from the leading end of the tip.

That is, in the pressurized ball-point pen refill, it is very difficult to prevent the ink leakage, to prevent also the faint lines and the degradation in the initial writing performance, and to sufficiently increase the writable distance.

Moreover, if the ink storage tube is formed to have a relatively small inner diameter, a capillary force can easily act within the ink storage tube, and the ink filled in the ink storage tube becomes hard to flow toward the end opposite to the tip even with the tip turned upward.

In the pressurized ball-point pen refill described above, however, both the ink and the pressuring gas should be filled in the ink storage tube, and, therefore, if the ink storage tube is formed to have a relatively small inner diameter, a filling space of the pressuring gas should be made relatively small, a filling amount of the ink should be made relatively small, or the ink storage tube should be formed to have a relatively large length.

However, if the filling space of the pressuring gas is made relatively small, the pressure of the pressuring gas may decrease to an atmospheric pressure before the ink is fully used, whereby the ink cannot be used to the end. Moreover, for making the filling space of the pressuring gas relatively small, and for also ensuring that the ink can be fully used, the pressuring gas should be adjusted to have a relatively high pressure, but, if so, the ink may leak from the leading end of the tip.

Moreover, if the amount of filled ink is made relatively small, the writable distance becomes relatively short.

Moreover, if the ink storage tube is formed to have a relatively large length, the total length of the ball-point pen refill becomes relatively large, but there is some limit on the length of the ball-point pen refill, and, therefore, the ink storage tube cannot be formed to have an unreasonably large length.

Thus, in the pressurized ball-point pen refill described above, the ink storage tube is formed to have a relatively large inner diameter.

However, if the ink storage tube is formed to have a large inner diameter, a capillary force becomes hard to act within the ink storage tube, and, therefore, the ink filled in the ink storage tube tends to flow toward the end opposite to the tip.

Thus, in the pressurized ball-point pen refill, the ink storage tube is formed to have a relatively large inner diameter, and a float traveling according to the decrease of the ink amount is provided between the ink and the pressuring gas to prevent the ink from flowing toward the end opposite to the tip.

However, even if the float is provided between the ink and the pressuring gas, the ink may flow toward the end opposite to the tip through a gap between the ink storage tube and the float if the outer diameter of the float is too small relative to the inner diameter of the ink storage tube.

On the other hand, if the outer diameter of the float is too large relative to the inner diameter of the ink storage tube, it maybe impossible to allow the float to travel smoothly according to the decrease of the ink amount.

That is, in the pressurized ball-point pen refill, it is very difficult to prevent outflow of the ink toward the end opposite to the tip.

DISCLOSURE OF THE INVENTION

The first object of the present invention is to provide a ball-point pen refill in which a ball house is formed to have an inner diameter falling within a proper range with respect to the diameter of a ball, and the ball is formed to have a surface roughness falling within a proper range, whereby ink leakage and ball dropout are prevented, faint lines and degradation in initial writing performance are also prevented, and a writable distance is sufficiently increased.

In addition to the above object, the present invention also aims to provide a ball-point pen refill in which ink is adjusted to have a viscosity falling within a proper range, whereby the ink leakage is more reliably prevented, the faint lines and the degradation in the initial writing performance are also more reliably prevented, and also writability does not become heavy.

In addition to the above object, the present invention also aims to provide a ball-point pen refill in which a structural viscosity imparting agent is added to the ink, whereby the ink leakage is more reliably prevented, and also the writability does not become heavy.

In addition to the above object, the present invention also aims to provide a ball-point pen refill in which pressuring gas is adjusted to have a pressure falling within a proper range, whereby the ink leakage and the ball dropout are more reliably prevented, the faint lines and the degradation in the initial writing performance are also more reliably prevented, and the ink can be fully used.

Moreover, in addition to the above object, the present invention also aims to provide a ball-point pen refill in which a ratio of a storage volume of the ink to a storage volume of the pressuring gas is adjusted to fall within a proper range, whereby the ink leakage and the ball dropout are more reliably prevented, the faint lines and the degradation in the initial writing performance are also more reliably prevented, and ink can be fully used.

Moreover, the second object of the present invention is to provide a ball-point pen refill in which ink is adjusted to have a viscosity falling within a proper range, and pressuring gas is adjusted to have a pressure falling within a proper range, whereby ink leakage is prevented, faint lines and degradation in initial writing performance are also prevented, and a writable distance is sufficiently increased.

In addition to the above object, the present invention also aims to provide a ball-point pen refill in which a ratio of a storage volume of the ink to a storage volume of the pressuring gas is adjusted to fall within a proper range, whereby the ink leakage is more reliably prevented, the faint lines and the degradation in the initial writing performance are also more reliably prevented, and the writable distance is sufficiently increased.

In addition to the above object, the present invention also aims to provide a ball-point pen refill in which a structural viscosity imparting agent is added to the ink, whereby the ink leakage is more reliably prevented, and also writability does not become heavy.

In addition to the above object, the present invention also aims to provide a ball-point pen refill in which a ratio of low-reactive gas in the pressuring gas is adjusted to fall within a proper range to prevent a drop in pressure of the pressuring gas due to reactions of gas such as oxygen ($O_2$) in the pressuring gas with components of the ink, whereby the faint lines and the degradation in the initial writing performance are more reliably prevented, and the writable distance is sufficiently increased.

In addition to the above object, the present invention also aims to provide a ball-point pen refill in which the low-reactive gas includes nitrogen ($N_2$) as a main component, whereby the handling thereof is made easier.

In addition to the above object, the present invention also aims to provide a ball-point pen refill in which an ink storage tube is formed integrally by metal material, part of a tip is pressed into the ink storage tube to fix the tip to the ink storage tube, and the part of ink storage tube near to the tip is annealed to adjust its hardness to fall within a proper range, whereby the faint lines and the degradation in the initial writing performance are more reliably prevented, the writable distance is sufficiently increased, the tip is prevented from being detached from the ink storage tube under the pressure of the pressuring gas, and it is made easier to fix the tip to the ink storage tube.

Moreover, the third object of the present invention is to provide a ball-point pen refill in which a float is formed to have an outer diameter falling within a proper range with respect to the inner diameter of an ink storage tube, whereby outflow of ink toward the end opposite to the tip is prevented, and also the float is made to travel smoothly according to the decrease of an ink amount.

In addition to the above object, the present invention also aims to provide a ball-point pen refill in which the ink is adjusted to have a viscosity falling within a proper range, whereby the outflow of the ink toward the end opposite to the tip can be prevented more reliably.

Moreover, in addition to the above object, the present invention also aims to provide a ball-point pen refill in which a structural viscosity imparting agent is added to the ink, whereby the outflow of the ink toward the end opposite to the tip can be prevented more reliably.

As a result of continuously conducting vigorous studies for achieving the above objects, the inventors have found that by forming a ball house to have an inner diameter falling within a proper range with respect to a diameter of a ball, and forming the ball to have a surface roughness falling within a proper range, the ink leakage and the ball dropout can be prevented, the faint lines and the degradation in the initial writing performance can be prevented, and the writable distance can be sufficiently increased, resulting in completion of the invention described below.

Specifically, the present invention provides a ball-point pen refill (10) comprising an ink storage tube (30), a tip (20) fixed to an end of the ink storage tube (30), and a tail plug (40) provided at an end of the ink storage tube (30) opposite to the tip (20); ink (80) being filled in the space of the ink storage tube (30) relatively near to the tip (20); pressuring gas (90) being filled in the space of the ink storage tube (30) relatively far from the tip (20); the ink (80) being squeezed to flow toward the tip (20) under the pressure of the pressuring gas (90); the tip (20) comprising a ball (50) and a holder (60) for holding the ball (50); the ball (50) being formed to have a surface roughness (Ra) of 0.010 $\mu$m to 0.080 $\mu$m; the holder (60) having a ball house (61) for housing the ball (50) provided in the vicinity of its end opposite to the ink storage tube (30), and an ink guiding hole (62) extending from its end opposite to the ball house (61) to the ball house (61) for supplying the ink (80); the ball house (61) having a cylindrical side part (70) and a conical bottom part (71) decreasing its inner diameter in the direction toward the ink guiding hole (62); and a formula $1.01 \leqq \phi B/\phi A \leqq 1.11$ being satisfied when $\phi A$ is a diameter of the ball (50) and $\phi B$ is an inner diameter of the side part (70).

Here, the "ball-point pen refill (10) comprising an ink storage tube (30), a tip (20) fixed to the ink storage tube (30) at an end, and a tail plug (40) provided at an end of the ink storage tube (30) opposite to the tip (20); ink (80) being filled in the space of the ink storage tube (30) near to the tip (20); pressuring gas (90) being filled in the space of the ink storage tube (30) relatively far from the tip (20); the ink (80) being squeezed to flow toward the tip (20) under the pressure of the pressuring gas (90)" refers to a so-called pressurized ball-point pen refill (10).

Moreover, the "ink storage tube (30)" maybe formed into, for example, a cylindrical shape.

Moreover, the ink storage tube (30) may be formed into a tubular shape, and thus, for example, the ink storage tube (30) may be formed to stepwise decrease its diameter in the direction from one end to another.

Specifically, for example, the ink storage tube (30) may be formed to have a cylindrical large-diameter part (31), a cylindrical intermediate-diameter part (32) smaller in diameter than the large-diameter part (31), formed in connection to an end of the large-diameter part (31), and a cylindrical small-diameter part (33) smaller in diameter than the intermediate-diameter part (32), formed in connection to an end of the intermediate-diameter part (32) opposite to the large-diameter part (31).

Moreover, for example, the ink storage tube (30) may be integrally formed by press working using metal material such as stainless or brass.

Moreover, the ink storage tube (30) is not necessarily formed using metal material but, for example, may be formed by extrusion molding, ejection molding or the like using plastic material.

Moreover, the ink storage tube (30) is not necessarily formed integrally, but may be formed, for example, in such a manner that an ink storage part for storing the ink (80) and a joint part for coupling the ink storage portion to the tip (20) are formed separately, and they are then coupled together.

Moreover, the "tail plug (40)" is intended for preventing the pressuring gas (90) filled in the ink storage tube (30) from leaking out.

Moreover, the tail plug (40) can be provided at an end of the ink storage tube (30) opposite to the tip (20) by, for example, being pressed into the end of the ink storage tube (30) opposite to the tip (20).

Moreover, the tail plug (40) may be provided at an end of the ink storage tube (30) opposite to the tip (20) by, for example, being screwed to the end of the ink storage tube (30) opposite to the tip (20).

Moreover, the tail plug (40) can be constituted by, for example, a metal latch (41) and a rubber seal member (42) provided at an end of the latch (41) near to the tip (20). The metal latch (41) can improve pressure resistance, and the rubber seal member (42) can improve air tightness.

Moreover, the tail plug (40) may be formed into a cylindrical shape using metal material, for example. When the tail plug (40) is pressed into the end of the ink storage tube (30) opposite to the tip (20), air tightness can be improved by, for example, packing a filler in a gap between the outer face of the tail plug (40) and the inner face of the ink storage tube (30).

Moreover, the "tip (20)" comprises the ball (50) and the holder (60) for holding the ball (50).

Moreover, the tip (20) can be fixed to an end of the ink storage tube (30) by, for example, an end of the tip (20) opposite to the ball (50) being pressed into the end of the ink storage tube (30).

Moreover, the tip (20) may be fixed to an end of the ink storage tube (30) by, for example, an end of the tip (20) opposite to the ball (50) being screwed into the end of the ink storage tube (30).

Moreover, the "ball (50)" is intended for coating a writing surface with ink.

Moreover, the ball (50) can be formed using, e.g., cemental carbides, stainless, sintered steel or ceramic.

Moreover, the "holder (60)" is intended for holding the ball (50).

Moreover, the holder (60) has the ball house (61) for housing the ball (50) and the ink guiding hole (62) for supplying ink to the ball (50).

Moreover, the holder (60) can be formed using, for example, a wire rod made of stainless, nickel-silver, brass, copper-zinc alloy or the like.

Moreover, the "ball house (61)" is provided in the vicinity of an end of the holder (60) opposite to the ink storage tube (30).

Moreover, the ball house (61) has the cylindrical side part (70), and the conical bottom part (71) gradually decreasing its inner diameter in the direction toward the ink guiding hole (62).

Moreover, the ball house (61) can be formed by, for example, boring a hole by a drill.

Moreover, the "ink guiding hole (62)" is formed to extend from the end of the holder (60) opposite to the ball house (61) to the ball house (61).

Moreover, the ink guiding hole (62) can be formed by, for example, boring a hole by a drill.

Moreover, the ball-point pen refill (10) is so formed that the ball (50) has a surface roughness (Ra) of 0.010 $\mu$m to 0.080 $\mu$m, and that the formula $1.01 \leqq \phi B/\phi A \leqq 1.11$ is satisfied when $\phi A$ is the diameter of the ball (50) and $\phi B$ is the inner diameter of the side part (70).

That is, the ball (50) is formed to have a surface roughness (Ra) of 0.010 $\mu$m to 0.080 $\mu$m, and the side part (70) is formed to have an inner diameter of 101% to 111% of the diameter of the ball (50).

The ball-point pen refill (10) has the ball (50) formed to have a surface roughness (Ra) of 0.010 $\mu$m to 0.080 $\mu$m, and the side part (70) formed to have an inner diameter of 101% to 111% of the diameter of the ball (50), whereby the ink leakage and the ball dropout are prevented, the faint lines and the degradation in the initial writing performance are also prevented, and the writable distance is sufficiently increased.

That is, by forming the ball (50) to have a surface roughness (Ra) of 0.010 $\mu$m or more, the frictional resistance between the ball (50) and the writing surface is increased, whereby slip of the ball (50) on the writing surface is reduced to prevent the faint lines and the degradation in the initial writing performance.

Moreover, by forming the ball (50) to have a surface roughness (Ra) of 0.080 $\mu$m or less, the ball seat (72) is prevented from wearing out, whereby durability of the tip (20) is so improved that the writable distance becomes sufficiently long.

Moreover, by forming the side part (70) to have an inner diameter of 101% or more of the diameter of the ball (50), a sufficient width of passage for the ink (80) is provided in the vicinity of the leading end of the tip (20), whereby the faint lines is prevented, and also the degradation in the initial writing performance is prevented.

Moreover, by forming the side part (70) to have an inner diameter of 111% or less of the diameter of the ball (50), the ink leakage is prevented, and also the ball dropout is prevented.

Moreover, if the ball (50) is formed to have a surface roughness (Ra) less than 0.010 $\mu$m, the frictional resistance between the ball (50) and the writing surface cannot be increased sufficiently, whereby the ball (50) tends to slip on the writing surface, and therefore the faint lines cannot be sufficiently inhibited, or the initial writing performance is degraded.

Moreover, if the ball (50) is formed to have a surface roughness (Ra) more than 0.080 $\mu$m, the ball seat (72) becomes prone to wear, whereby the writability is degraded shortly after the ball-point pen is used for the first time, or the writable distance decreases relatively.

Moreover, if the side part (70) is formed to have an inner diameter less than 101% of the diameter of the ball (50), a sufficient width of ink passage cannot be provided between the ball (50) and the side part (70), whereby faint lines tend to occur, or the initial writing performance is degraded.

Moreover, if the side part (70) is formed to have an inner diameter more than 111% of the diameter of the ball (50), the ink (80) tends to leak from the leading end of the tip (20), or the ball (50) tends to drop out from the ball house (61).

In addition to the configurations of the invention described above, the present invention is characterized in that the ink (80) is formulated to have a viscosity of 10,000 mPa·s to 50,000 mPa·s at 25° C.

In this way, in the ball-point pen refill (10), the ink (80) is adjusted to have a viscosity of 10,000 mPa·s to 50,000 mPa·s at 25° C., whereby the ink leakage is more reliably prevented, the faint lines and the degradation in the initial writing performance are also more reliably prevented, and the writability becomes smooth.

Moreover, if the viscosity of the ink (80) is less than 10,000 mPa·s at 25° C., it may be impossible to reliably prevent the ink (80) from leaking from the leading end of the tip (20).

On the other hand, if the viscosity of the ink (80) is more than 50,000 mPa·s at 25° C., it maybe impossible to reliably prevent the faint lines and the degradation in the initial writing performance, and the writability may become heavy.

In addition to the configurations of the invention described above, the present invention is characterized in that the ink (80) includes a structural viscosity imparting agent.

Here, the "structural viscosity imparting agent" is intended for increasing the viscosity of the ink (80) and imparting a structural viscosity to the ink (80).

The ink (80) including the structural viscosity imparting agent has a relatively high viscosity under a low shear rate, but has a relatively low viscosity under a high shear rate.

Moreover, for the structural viscosity imparting agent, e.g., carbon black (specifically, e.g., Carbon Black MA-100 (trade name, Mitsubishi Chemical Co., Ltd.)), and particulate silica (specifically, e.g., Aerosyl 380 (trade name, Nihon Aerosyl Co., Ltd.)) may be used.

In the ball-point pen refill (10), the structural viscosity imparting agent is added to the ink (80), whereby the ink leakage is more reliably prevented, and the writability becomes smooth.

That is, the ink (80) is situated under a low shear rate in the vicinity of the leading end of the tip (20) when writing is not performed. Thus, the ink (80) added with the structural viscosity imparting agent has a relatively high viscosity in the vicinity of the leading end of the tip (20) when writing is not performed. In this way, ink leakage from the leading end of the tip (20) can be more reliably prevented.

On the other hand, the ink (80) is situated under a high shear rate in the vicinity of the leading end of the tip (20) when writing is performed. Thus, the ink (80) with the structural viscosity imparting agent has a relatively low viscosity in the vicinity of the leading end of the tip (20) when writing is performed. In this way, the writability can become smooth.

In addition to the configurations of the invention described above, the present invention is characterized in that the pressuring gas (90) is set to have an absolute pressure of 0.15 MPa to 0.4 MPa after assembly of the ball-point pen refill (10).

In this way, in the ball-point pen refill (10), the pressuring gas (90) is adjusted to have an absolute pressure of 0.15 MPa to 0.4 MPa after assembly of the ball-point pen refill (10), the ink leakage and the ball dropout can be more reliably prevented, the faint lines and the degradation in the initial writing performance can also be prevented more reliably, and the ink (80) can be used to the end.

Moreover, if the absolute pressure of the pressuring gas (90) is less than 0.15 MPa after assembly of the ball-point pen refill (10), it may be impossible to reliably prevent the faint lines and the degradation in the initial writing performance, and it may be impossible to use the ink (80) to the end.

On the other hand, if the absolute pressure of the pressuring gas (90) is more than 0.4 MPa after assembly of the ball-point pen refill (10), it may be impossible to reliably prevent the ink leakage and the ball dropout.

Moreover, in addition to the configurations of the invention described above, the present invention is characterized in that a formula $VA \times 2 \leqq VB \leqq VA \times 5$ is satisfied when VA is a storage volume of the ink (80) after assembly of the ball-point pen refill (10), and VB is a storage volume of the pressuring gas (90) after assembly of the ball-point pen refill (10).

That is, the ball-point pen refill (10) is so formed that the storage volume of the pressuring gas (90) after assembly of the ball-point pen refill (10) is twice to five times as large as the storage volume of the ink (80) after assembly of the ball-point pen refill (10).

Here, the "storage volume" refers to a volume when stored in the ink storage tube (30).

That is, the "storage volume of the ink (80)" refers to the volume of the ink (80) when stored in the ink storage tube (30), and the "storage volume of the pressuring gas (90)" refers to the volume of the pressuring gas (90) when stored in the ink storage tube (30).

The ball-point pen refill (10) is so formed that the storage volume of the pressuring gas (90) after assembly of the ball-point pen refill (10) is twice to five times as large as the storage volume of the ink (80) after assembly of the ball-point pen refill (10), whereby the ink leakage and the ball dropout can be more reliably prevented, the faint lines and the degradation in the initial writing performance can also be prevented more reliably, and the ink (80) can be used to the end to sufficiently increase the writable distance.

Moreover, if VA×2 is more than VB, in other words the storage volume of the pressuring gas (90) after assembly of the ball-point pen refill (10) is less than twice as large as the storage volume of the ink (80) after assembly of the ball-point pen refill (10), it may be impossible to reliably prevent the ink leakage and the ball dropout, it may be impossible to reliably prevent the faint lines and the degradation in the initial writing performance, and it may be impossible to use the ink (80) to the end, thus reducing the writable distance.

On the other hand, if VB is more than VA×5, in other words the storage volume of the pressuring gas (90) after assembly of the ball-point pen refill (10) is more than five times as large as the storage volume of the ink (80) after assembly of the ball-point pen refill (10), the filling amount of the ink (80) may become relatively small, thus reducing the writable distance.

As a result of continuously conducting vigorous studies for achieving the objects described above, the inventors have found that, by preparing the ink to have a viscosity falling within a proper range, and adjusting the pressuring gas to have a pressure falling within a proper range, the ink leakage can be prevented, the faint lines and the degradation in the initial writing performance can be prevented, and the writable distance can be sufficiently increased, resulting in completion of the invention described below.

Specifically, the present invention provides a ball-point pen refill (10) comprising an ink storage tube (30), a tip (20) fixed to an end of the ink storage tube (30), and a tail plug (40) provided at an end of the ink storage tube (30) opposite to the tip (20); ink (80) being filled in the space of the ink storage tube (30) relatively near to the tip (20); pressuring gas (90) being filled in the space of the ink storage tube (30) relatively far from the tip (20); the ink (80) being squeezed to flow toward the tip (20) under the pressure of the pressuring gas (90); the ink (80) being formulated to have a viscosity of 10,000 mPa·s to 50,000 mPa·s at 25° C.; the pressuring gas (90) being set to have an absolute pressure of 0.15 MPa to 0.4 MPa after assembly of the ball-point pen refill (10).

Here, in the ball-point pen refill (10), the viscosity of the ink (80) is 10,000 mPa·s to 50,000 mPa·s at 25° C., and the absolute pressure of the pressuring gas (90) is 0.15 MPa to 0.4 MPa after assembly of the ball-point pen refill (10).

That is, the ink (80) is adjusted to have a viscosity of 10,000 mPa·s to 50,000 mPa·s at 25° C., and the pressuring gas (90) is adjusted to have an absolute pressure of 0.15 MPa to 0.4 MPa after assembly of the ball-point pen refill (10).

In the ball-point pen refill (10), the ink (80) is adjusted to have a viscosity of 10,000 mPa·s to 50,000 mPa·s at 25° C., and the pressurizing gas (90) is adjusted to have an absolute pressure of 0.15 MPa to 0.4 MPa after assembly of the ball-point pen refill (10), whereby the ink leakage is prevented, the faint lines and the degradation in the initial writing performance are also prevented, and the writable distance is sufficiently increased.

That is, by preparing the ink (80) to have a viscosity of 10,000 mPa·s or more at 25° C., the ink leakage from the leading end of the tip (20) is prevented.

Moreover, by preparing the ink (80) to have a viscosity of 50,000 mPa·s or less at 25° C., the faint lines and the degradation in the initial writing performance are prevented, and the writability does not become heavy.

Moreover, by adjusting the pressuring gas (90) to have an absolute pressure of 0.15 MPa or more after assembly of the ball-point pen refill (10), the faint lines and the degradation in the initial writing performance can be prevented, and the ink can be used to the end to increase the writable distance.

Moreover, by adjusting the pressuring gas (90) to have an absolute pressure of 0.4 MPa or less in atmosphere after assembly of the ball-point pen refill (10), the ink leakage from the leading end of the tip (20) is prevented.

If the ink (80) is adjusted to have a viscosity less than 10,000 mPa·s at 25° C., the ink (80) may leak from the leading end of the tip (20).

Moreover, if the ink (80) is adjusted to have a viscosity more than 50,000 mPa·s at 25° C., the faint lines tend to occur, the initial writing performance is degraded, or the writability becomes heavy.

Moreover, if the pressuring gas (90) is adjusted to have an absolute pressure less than 0.15 MPa after assembly of the ball-point pen refill (10), the faint lines tend to occur, the initial writing performance is degraded, or the ink cannot be used to the end, thus reducing the writable distance.

Moreover, if the pressuring gas (90) is adjusted to have an absolute pressure more than 0.4 MPa after assembly of the ball-point pen refill (10), the ink (80) may leak from the leading end of the tip (20).

In addition to the configurations of the invention described above, the present invention is characterized in that a formula $VA \times 2 \leqq VB \leqq VA \times 5$ is satisfied when VA is the storage volume of ink (80) after assembly of the ball-point pen refill, and VB is the storage volume of pressuring gas (90) after assembly of the ball-point pen refill (10).

That is, the ball-point pen refill (10) is so formed that the storage volume of pressuring gas (90) after assembly of the ball-point pen refill (10) is twice to five times as large as the storage volume of ink (80) after assembly of the ball-point pen refill (10).

The ball-point pen refill (10) is so formed that the storage volume of pressuring gas (90) after assembly of the ball-point pen refill (10) is twice to five times as large as the storage volume of ink (80) after assembly of the ball-point pen refill (10), whereby the ink leakage can be more reliably prevented, the faint lines and the degradation in the initial writing performance can also be prevented more reliably, and the ink (80) can be used to the end to sufficiently increase the writable distance.

Moreover, if the storage volume of pressuring gas (90) after assembly of the ball-point pen refill (10) is less than twice as large as the storage volume of ink (80) after assembly of the ball-point pen refill (10), it may be impossible to reliably prevent the ink leakage, it may be impossible to reliably prevent the faint lines and the degradation in the initial writing performance, and it may be impossible to use the ink (80) to the end, thus reducing the writable distance.

On the other hand, if the storage volume of pressuring gas (90) after assembly of the ball-point pen refill (10) is more than five times as large as the storage volume of ink (80) after assembly of the ball-point pen refill (10), the filling amount of ink (80) may become relatively small, thus reducing the writable distance.

In addition to the configurations of the invention described above, the present invention is characterized in that the ink (80) includes a structural viscosity imparting agent.

Here, the "structural viscosity imparting agent" is intended for increasing the viscosity of the ink (80) and imparting a structural viscosity to the ink (80).

The ink (80) including the structural viscosity imparting agent has a relatively high viscosity under a low shear rate, but has a relatively low viscosity under a high shear rate.

In addition to the configurations of the invention described above, the present invention is characterized in that the pressuring gas (90) is prepared to include 85% of low-reactive gas or more in the total amount of the pressuring gas (90).

Here, the "low-reactive gas" means, e.g., nitrogen ($N_2$), helium (He), neon (Ne), argon (Ar), krypton (Kr) and xenon (Xe). Each one of them can be used alone, otherwise two or more of them can be appropriately combined to use.

In the ball-point pen refill (10), the content of the low-reactive gas in the pressuring gas (90) is made to be 85% or more to prevent a drop in pressure of the pressuring gas (90) due to reactions of gas such as oxygen ($O_2$) in the pressuring gas (90) with components of the ink, whereby the faint lines and the degradation in the initial writing performance are reliably prevented, and the writable distance is sufficiently increased.

That is, gas such as oxygen ($O_2$) easily reacts with the components of the ink (80). If the gas such as oxygen ($O_2$) reacts with the components of the ink (80), the ink (80) is deteriorated. Moreover, if oxygen ($O_2$) or the like reacts with the components of the ink (80), not only the ink (80) is deteriorated, but also the amount of the gas such as oxygen ($O_2$) in the pressuring gas (90) decreases. Consequently, the pressure of the pressuring gas (90) correspondingly decreases as the amount of the high-reactive gas such as oxygen ($O_2$) decreases. Thus, the content of the low-reactive gas in the pressuring gas (90) is made to be 85% or more to prevent the reactions between the high-reactive gas such as oxygen ($O_2$) and the ink (80) wherever possible, whereby the drop in pressure of the pressuring gas (90) is prevented. Then the faint lines and the degradation in the initial writing performance are more reliably prevented, and the writable distance is sufficiently increased.

If the content of the low-reactive gas in the pressuring gas (90) is smaller than 85%, the gas such as oxygen ($O_2$) easily reacts with the components of the ink (80) and consequently, the ink (80) is easily deteriorated. Moreover, if the content of low-reactive gas in the pressuring gas (90) is smaller than 85%, the pressure of the pressuring gas (90) easily decreases and consequently, the faint lines may be more likely to occur, the initial writing performance may be degraded, or it may be impossible to use the ink (80) to the end, thus reducing the writable distance.

In addition to the configurations of the invention described above, the present invention is characterized in that the low-reactive gas includes nitrogen ($N_2$) as a main component.

Since the low-reactive gas includes nitrogen ($N_2$) as a main component, the low-reactive gas may include gas other than nitrogen ($N_2$) (e.g., helium (He), neon (Ne), argon (Ar), krypton (Kr) and xenon (Xe) etc.).

In the ball-point pen refill (10), the low-reactive gas includes nitrogen ($N_2$) as a main component, whereby assembly and handling thereof are made easier.

In addition to the configurations of the invention described above, the present invention is characterized in that the ink storage tube (30) is integrally formed using metal material, an end of the tip (20) opposite to the ball (50) is fixed to an end of the ink storage tube (30) by being pressed into the end of the ink storage tube (30), and a portion around the end of the ink storage (30) tube near to the tip (20) is annealed to be adjusted to have a hardness of 50 to 400 by Vickers' hardness (Hv).

In this way, in the ball-point pen refill (10), the ink storage tube (30) is integrally formed using metal material, the end of the tip (20) opposite to the ball (50) is pressed into the end of the ink storage tube (30) to fix the tip (20) to the end of the ink storage tube (30), and a portion around the end of the ink storage tube (30) near to the tip (20) is annealed to adjust its hardness to fall within the range of 50 to 400 by Vickers' hardness (Hv), whereby the faint lines and the degradation in the initial writing performance are reliably prevented, the writable distance is sufficiently increased, the tip (20) is prevented from being detached from the ink storage tube (30) under the pressure of the pressuring gas (90), and the fixing of the tip (20) to the ink storage tube (30) is made easier.

That is, the ink storage tube (30) is integrally formed by metal material to prevent leakage of the pressuring gas (90), whereby a drop in pressure of the pressuring gas (90) is prevented. Then the faint lines and the degradation in the initial writing performance are more reliably prevented, and the writable distance is sufficiently increased.

Moreover, the end of the tip (20) opposite to the ball (50) is pressed into the end of the ink storage tube (30) to fix the tip (20) to the end of the ink storage tube (30), whereby assembly of the ball-point pen refill (10) is made much easier.

Moreover, a portion around the end of the ink storage tube (30) near to the tip (20) is annealed, thereby preventing stress-corrosion cracking caused by the end of the tip (20) opposite to the ball (50) being pressed into the ink storage tube (30).

Moreover, a portion around the end of the ink storage tube (30) near to the tip (20) is annealed to adjust its hardness to fall within the range of 50 to 400 by Vickers' hardness (Hv), whereby the tip (20) is prevented from being detached from the ink storage tube (30) under the pressure of the pressuring gas (90), and also the fixing of the tip (20) to the ink storage tube (30) is made easier.

If the hardness of the portion around the end of the ink storage tube (30) near to the tip (20) is less than 50 by Vickers' hardness (Hv), the tip (20) maybe detached from the ink storage tube (30) under the pressure of the pressuring gas (90). Moreover, if the hardness of the portion around the end of the ink storage tube (30) near to the tip (20) is less than 50 by Vickers' hardness (Hv), the portion may be damaged when writing is performed under a high load.

On the other hand, if the hardness of the portion around the end of the ink storage tube (30) near to the tip (20) is more than 400 by Vickers' hardness (Hv), it becomes difficult to press the end of the tip (20) opposite to the ball (50) into the ink storage tube (30).

Moreover, as a result of continuously conducting vigorous studies for achieving the objects described above, the inventors have found that by forming a float to have an outer diameter falling within a proper range with respect to the inner diameter of the ink storage tube, the flow of the ink in toward the end opposite to the tip can be prevented, and the float can be made to travel smoothly according to the decrease of the ink amount, resulting in completion of the invention described below.

Specifically, the present invention provides a ball-point pen refill (10) comprising an ink storage tube (30), a tip (20) fixed to an end of the ink storage tube (30), and a tail plug (40) provided at an end of the ink storage tube (30) opposite to the tip (20); ink (80) being filled in the space of the ink storage tube (30) relatively near to the tip (20); pressuring gas (90) being filled in the space of the ink storage tube (30)

relatively far from the tip (20); the ink (80) being squeezed to flow toward the tip (20) under the pressure of the pressuring gas (90); afloat (100) which travels through a fixed range according to decrease of the ink amount being provided between the ink (80) and the pressuring gas (90) in the ink storage tube (30); and a formula of $0.0005 \leqq (\phi D - \phi C)/\phi C \leqq 0.043$ is satisfied when $\phi C$ is an outer diameter of the float (100) and $\phi D$ is an inner diameter of the ink storage tube (30) in the range where the float (100) travels.

Here, the "float (100)" is intended for preventing the ink (80) filled in the ink storage tube (30) from flowing toward the end opposite to the tip (20).

Moreover, the float (100) is provided between the ink (80) and the pressuring gas (90) in the ink storage tube (30) and is so formed that it can travel through a fixed range according to the decrease of the ink amount.

Moreover, if the ink storage tube (30) is formed into a cylindrical shape, the float (100) can be formed into, for example, a columnar shape.

Moreover, if the ink storage tube (30) is formed into a hexagonal cylindrical shape, the float (100) can be formed into, for example, a hexagonal columnar shape.

Moreover, if the ink storage tube (30) is formed to have a cylindrical large-diameter part (31), a cylindrical intermediate-diameter part (32) smaller in diameter than the large-diameter part (31) formed in connection to an end of the large-diameter part (31), and a cylindrical small-diameter part (33) smaller in diameter than the intermediate-diameter part (32) formed in connection to an end of the intermediate-diameter part (32) opposite to the large-diameter part (31), for example, the float (100) can be formed into a columnar shape and provided in the large diameter part (31). In this case, for example, the inner space of the large diameter part (31) may be a range through which the float (100) travels.

Moreover, the float (100) may be integrally formed, for example, by injection molding using a synthetic resin such as polypropylene (PP).

Moreover, the ball-point pen refill (10) according to the present invention is so formed that the formula $0.0005 \leqq (\phi D - \phi C)/\phi C \leqq 0.043$ is satisfied when $\phi C$ is the outer diameter of the float (100), and $\phi D$ is the inner diameter of the range of the ink storage tube (30) through which the float (100) travels.

For forming the ball-point pen refill (10) so as to satisfy the above formula with respect to the relation between $\phi C$ and $\phi D$, a predetermined gap is provided between the float (100) and the ink storage tube (30), whereby the float (100) moves smoothly according to the decrease of the ink amount, and the ink (80) becomes hard to flow to end where the pressuring gas (90) exists through the gap between the float (100) and the ink storage tube (30).

If the ball-point pen refill (10) is formed so as to satisfy the formula of $0.0005 > (\phi D - \phi C)/\phi C$, the gap between the float (100) and the ink storage tube (30) may become so narrow that the float (100) cannot move smoothly according to the decrease of the ink amount.

Moreover, if the ball-point pen refill (10) is formed so as to satisfy the formula of $(\phi D - \phi C)/\phi C > 0.043$, the gap between the float (100) and the ink storage tube (30) may become so wide that the ink (80) flows out to the end where the pressuring gas (90) exists through the gap between the float (100) and the ink storage tube (30).

In addition to the configurations of the invention described above, the present invention is characterized in that the ink (80) is formulated to have a viscosity of 10,000 mPa·s to 50,000 mPa·s at 25° C.

In this way, in the ball-point pen refill (10), the ink (80) is adjusted to have a viscosity of 10,000 mPa·s to 50,000 mPa·s at 25° C., whereby the ink (80) becomes harder to flow to the end where the pressuring gas (90) exists through the gap between the float (100) and the ink storage tube (30).

Moreover, if the viscosity of the ink (80) is less than 10,000 mPa·s at 25° C., it may be impossible to reliably prevent the ink (80) from flowing to the end where the pressuring gas (90) exists through the gap between the float (100) and the ink storage tube (30).

On the other hand, if the viscosity of the ink (80) is more than 50,000 mPa·s at 25° C., the writability may become heavy.

In addition to the configurations of the invention described above, the present invention is characterized in that the ink (80) includes a structural viscosity imparting agent.

Here, the "structural viscosity imparting agent" is intended for increasing the viscosity of the ink (80) and imparting a structural viscosity to the ink (80).

In the ball-point pen refill (10), by adding the structural viscosity imparting agent to the ink (80), the viscosity of the ink (80) is increased, and a structural viscosity is imparted to the ink (80), whereby the ink (80) becomes harder to flow to the end where the pressuring gas (90) exists through the gap between the float (100) and the ink storage tube (30).

BEST MODE FOR CARRYING OUT THE INVENTION

Figure 1:
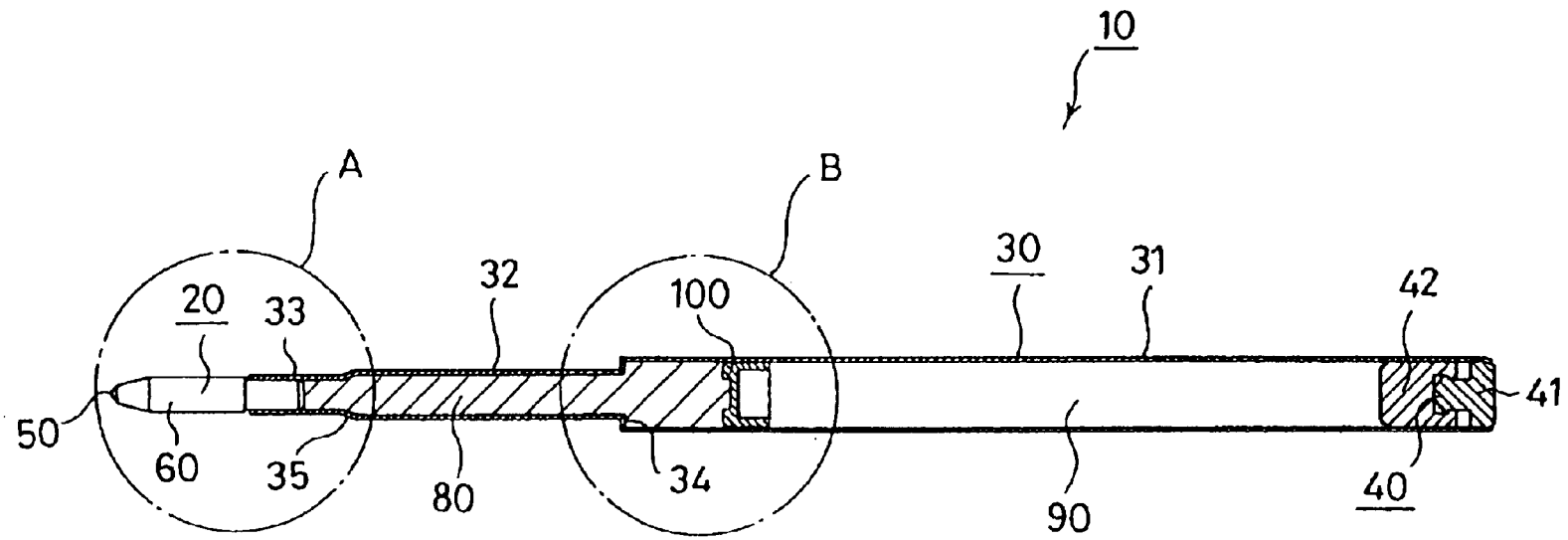
FIG. 1 is a side sectional view of a ball-point pen refill 10 according to the embodiment.
Figure 2:
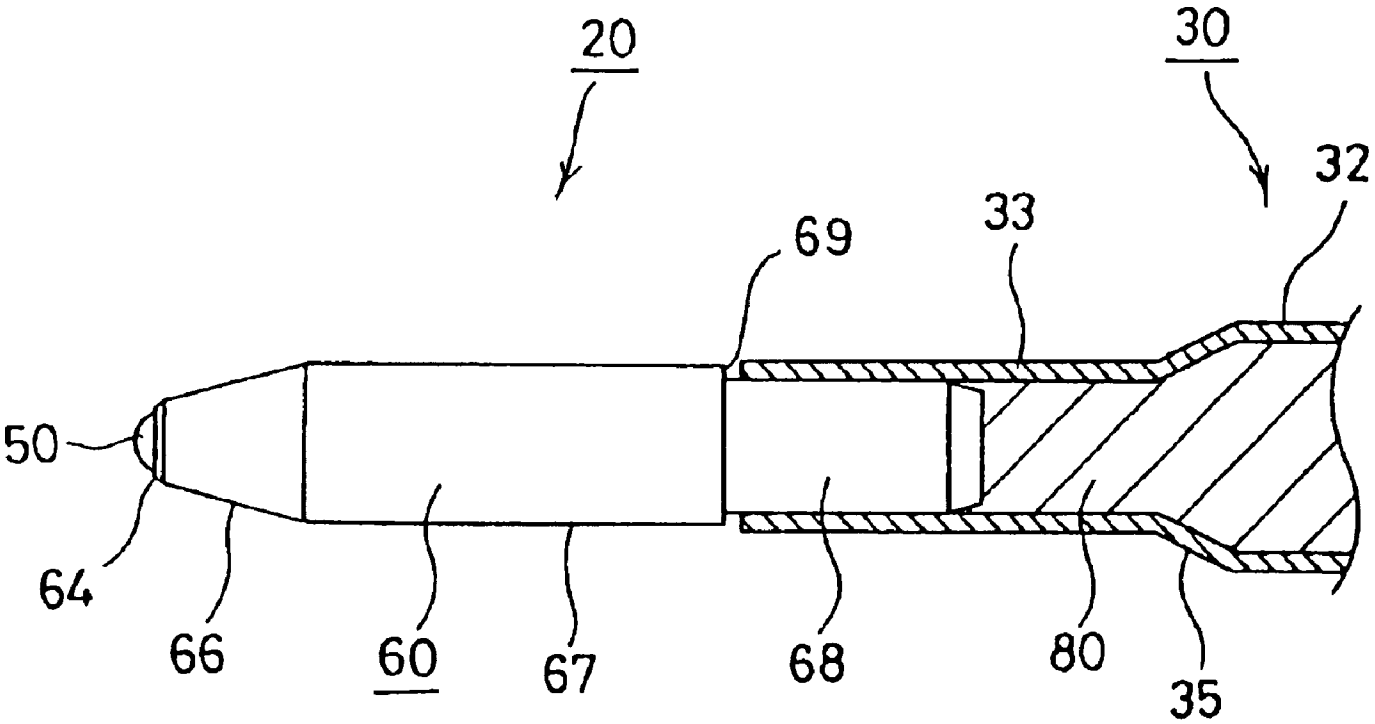
FIG. 2 is a magnified view of part A of FIG. 1.
Figure 3:
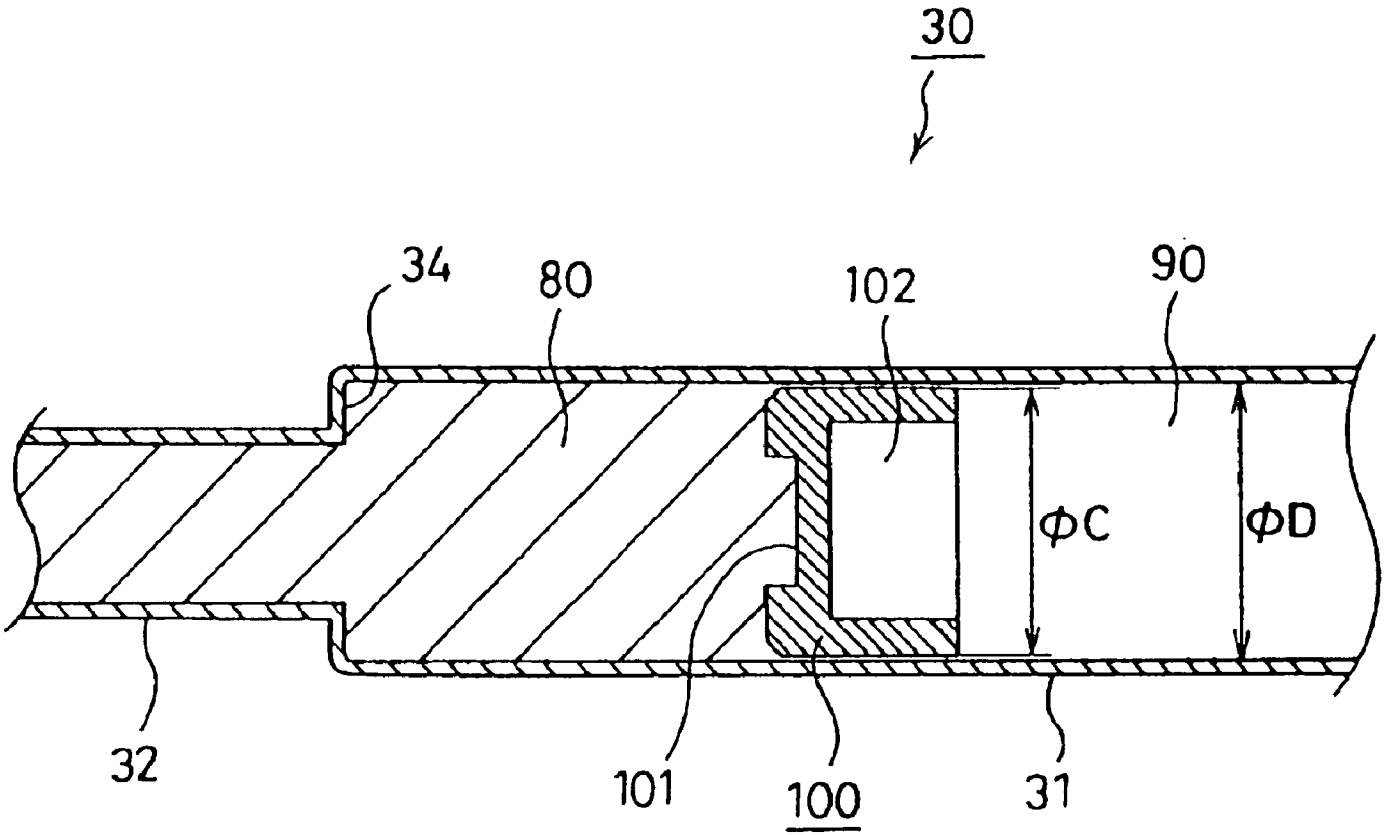
FIG. 3 is a magnified view of part B of FIG. 1.
Figure 4:
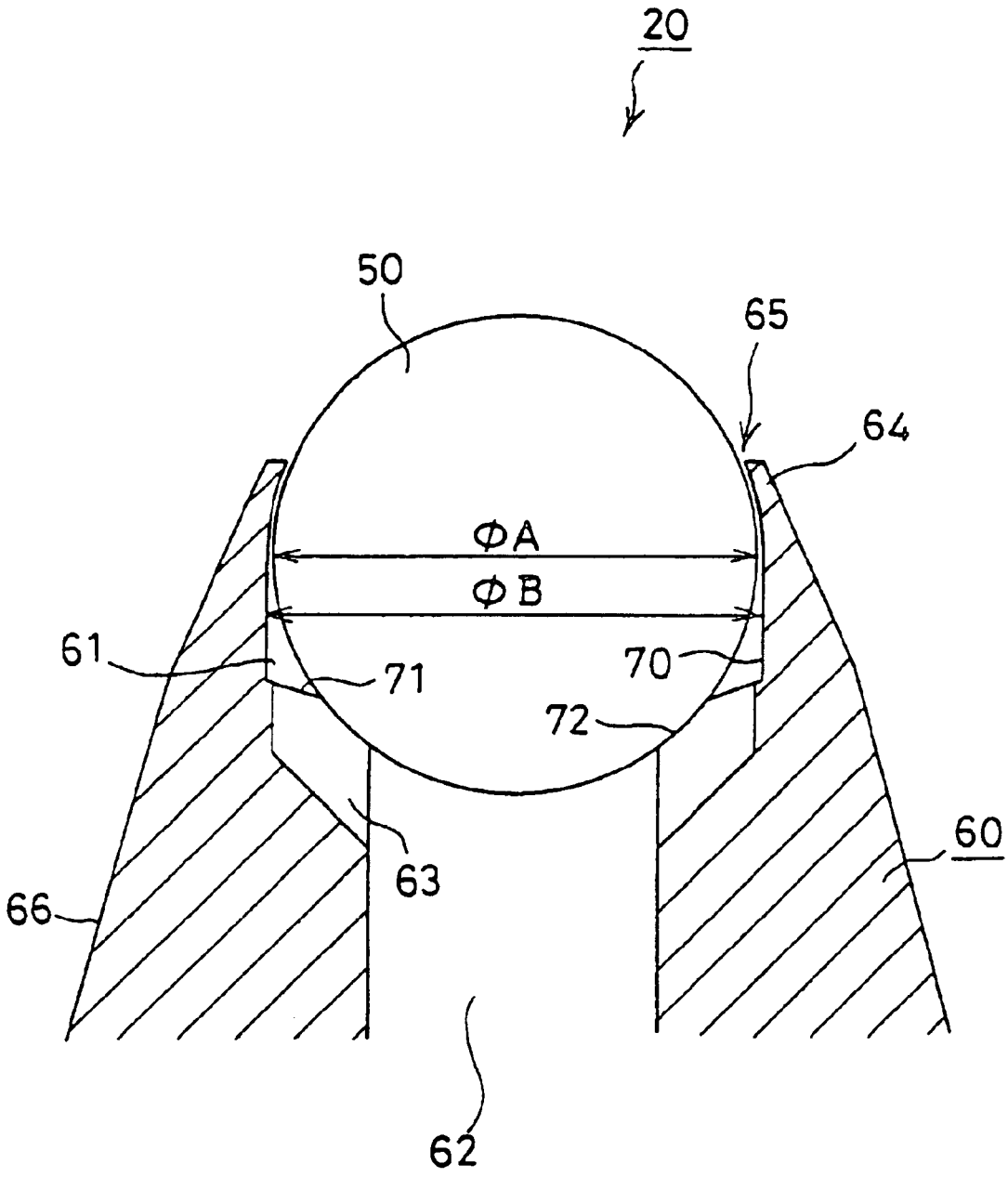
FIG. 4 is a sectional view of a main part of a tip 20.
Figure 5:
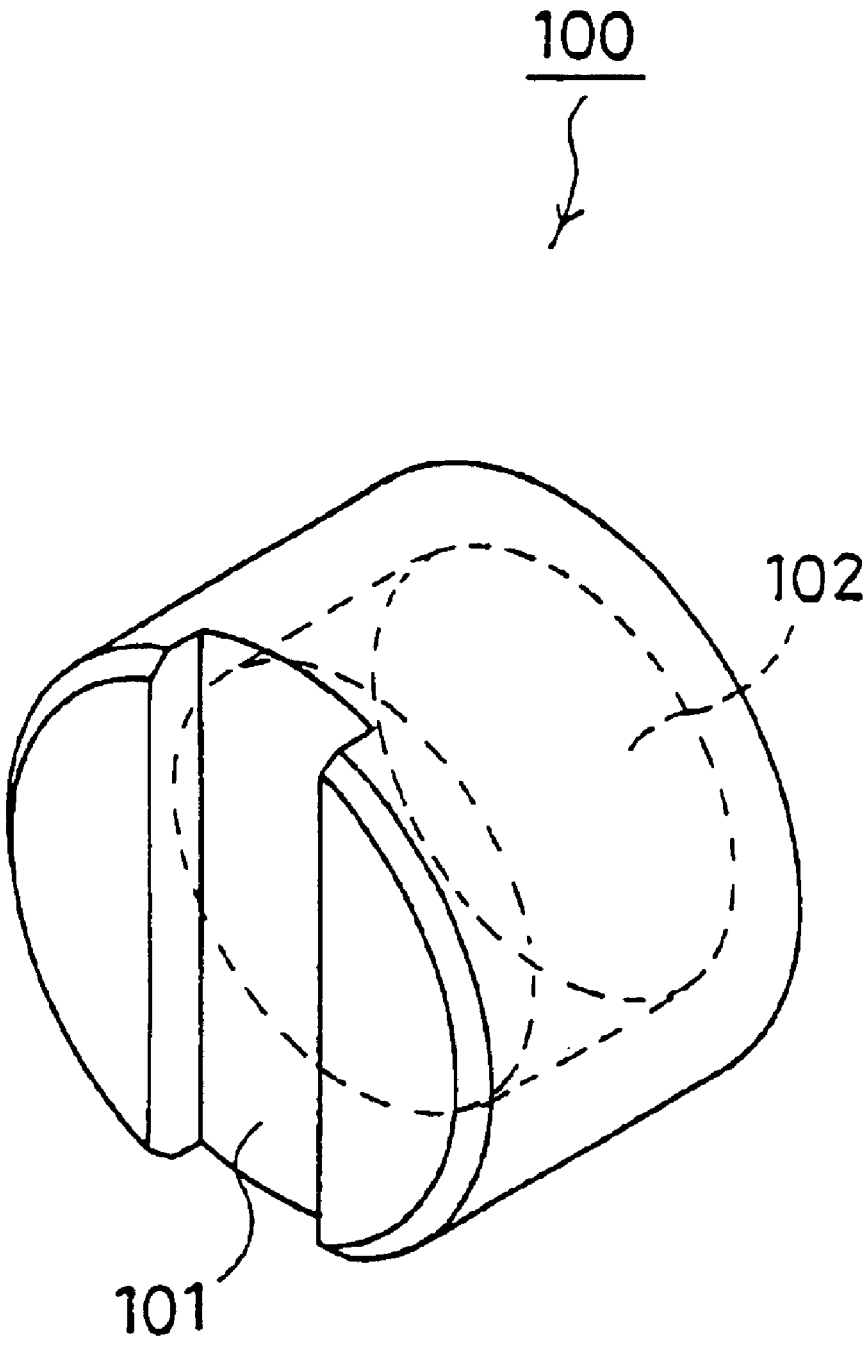
FIG. 5 is a perspective view of a float 100.

A ball-point pen refill 10 according to the embodiment comprises a tip 20, an ink storage tube 30 fixed to the tip 20, and a tail plug 40 provided at an end of the ink storage tube 30 opposite to the tip 20.

The tip 20 comprises a ball 50 and a holder 60 for holding the ball 50, and the holder 60 comprises a ball house 61 for housing the ball 50, an ink guiding hole 62 for supplying ink 80 to the ball 50, a plurality of ink grooves 63 for enabling the ink 80 to be supplied sufficiently to the ball 50, and a bent part 64 for preventing the ball 50 housed in the ball house 61 from dropping out.

Moreover, the ink storage tube 30 is approximately formed into a cylindrical shape, in the space of which relatively near to the tip 20 the ink 80 is filled, and in the space of which relatively far from the tip 20 pressuring gas 90 is filled. Moreover, a float 100 traveling through a fixed range according to the decrease of the ink amount is provided between the ink 80 and the pressuring gas 90 in the ink storage tube 30.

The tail plug 40 is pressed into an end of the ink storage tube 30 opposite to the tip 20 so that the pressuring gas 90 filled in the space of the ink storage tube 30 relatively far from the tip 20 may not leak out.

Hereinafter the ball-point pen refill 10 according to this embodiment will be described further in detail.

(Tip 20)

The tip 20 comprises the ball 50 and the ball holder 60 for holding the ball 50.

(Ball 50)

The ball 50 is intended for coating a writing surface with the ink 80.

The ball 50 is formed using cemental carbides, stainless, sintered steel, ceramic or the like.

Moreover, the ball 50 is formed into a spherical shape, and is formed to have a surface roughness (Ra) of 0.010 μm to 0.080 μm.

By forming the ball 50 to have a surface roughness (Ra) of 0.010 μm to 0.080 μm, a frictional resistance between the ball 50 and the writing surface is increased, whereby slip of the ball 50 on the writing surface is reduced to inhibit faint lines and improve an initial writing performance which means that a faint line hardly appears when writing is started.

If the surface roughness (Ra) of the ball 50 is less than 0.010 μm, the frictional resistance between the ball 50 and the writing surface cannot be increased sufficiently, whereby the ball 50 tends to slip on the writing surface, and therefore the faint lines cannot be inhibited sufficiently, or the initial writing performance is degraded.

Moreover, if the surface roughness (Ra) of the ball 50 is more than 0.080 μm, a ball seat 72 becomes prone to wear, whereby writability becomes heavy relatively shortly after the ball-point pen is used for the first time, or a writable distance is decreased.

(Holder 60)

The holder 60 is intended for holding the ball 50.

The holder 60 is formed using a wire rod made of stainless, nickel-silver, brass, copper-zinc alloy or the like.

Moreover, the holder 60 comprises the ball house 61 for housing the ball 50, the ink guiding hole 62 for supplying the ink 80 to the ball 50 housed in the ball house 61, a plurality of ink grooves 63 for enabling the ink 80 to be supplied sufficiently to the ball 50 housed in the ball house 61, and the bent part 64 for preventing the ball 50 housed in the ball house 61 from dropping out.

Moreover, the holder 60 comprises a conical tapered part 66 gradually increasing its outer diameter in the direction opposite to the bent part 64, a cylindrical body part 67 provided in connection to an end of the tapered part 66 opposite to the bent part 64, a cylindrical fixing part 68 smaller in diameter than the body part 67 provided in connection to an end of the body part 67 opposite to the tapered part 66, and a step-shaped outward step part 69 provided between the body part 67 and the fixing part 68.

Hereinafter each part of the holder 60 will be described further in detail.

(Ball House 61)

The ball house 61 is intended for housing the ball 50.

The ball house 61 is provided in the vicinity of an end of the holder 60.

Moreover, the ball house 61 comprises a cylindrical side part 70, and a conical bottom part 71 gradually decreasing its inner diameter in the direction toward the ink guiding hole 62.

Moreover, the ball house 61 is formed by boring a hole through a wire rod in the direction from an end to another by a drill with its rotation axis matched with the center axis of the wire rod.

Moreover, around the opening of the ink guiding hole 62, the bottom part 71 has a concaved spherical ball seat 72 almost identical in curvature to the ball 50.

Moreover, the ball seat 72 is formed by pressing the ball 50 toward the ink guiding hole 62 by a hammer after housing the ball 50 in the ball house 61.

Moreover, the side part 70 is formed to have an inner diameter of 101% to 111% of the diameter of the ball 50.

That is, the side part 70 is so formed that a formula $1.01 \leqq \phi B/\phi A \leqq 1.11$ (formula 1) is satisfied when $\phi A$ is the diameter of the ball 50, and $\phi B$ is the inner diameter of the side part 70.

By forming the side part 70 to have an inner diameter of 101% to 111% of the diameter of the ball 50, a sufficient wide passage for the ink 80 is provided between the ball 50 and the side part 70, whereby the faint lines are inhibited, and the initial writing performance is improved.

If the inner diameter of the side part 70 is smaller than 101% of the diameter of the ball 50, a sufficient wide passage for the ink 80 cannot be provided between the ball 50 and the side part 70, whereby the faint lines tend to occur, or the initial writing performance is degraded.

Moreover, if the inner diameter of the side part 70 is larger than 111% of the diameter of the ball 50, the ink 80 may leak from the leading end of the tip 20, or the ball 50 may drop out from the ball house 61.

(Ink Guiding Hole 62)

The ink guiding hole 62 is intended for supplying the ink 80 to the ball 50 housed in the ball house 61.

The ink guiding hole 62 extends from an end of the holder 60 opposite to the ball house 61 to the ball house 61.

Moreover, the ink guiding hole 62 is formed by boring a hole through a wire rod from its end opposite to the ball house 61 in the direction toward the ball house 61 by a drill with its rotation axis matched with the center axis of the wire rod.

(Ink Grooves 63)

The ink grooves 63 are intended for enabling the ink 80 to be supplied sufficiently to the ball 50 housed in the ball house 61.

The ink grooves 63 are provided on a part the inner face of the ink guiding hole 62 near to the ball house 61 radially from the center of the ink guiding hole 62.

Moreover, the ink guiding hole 62 is formed by broaching the wire rod from the ball house 61 to the direction opposite to the ball house 61.

(Bent Part 64)

The bent part 64 is intended for preventing the ball 50 housed in the ball house 61 from dropping out.

The bent part 64 is provided at an end of the holder 60 near to the ball house 61.

Moreover, the bent part 64 is formed into a conical shape, and is so formed that the inner diameter of its smallest-diameter part 33 is smaller than the diameter of the ball 50.

Moreover, the bent part 64 is formed by rolling the end of a wire rod near to the ball house 61 after housing the ball 50 in the ball house 61.

The ball 50 is rotatably held at the end of the holder 60 by the bent part 64 with a part of the ball 50 being protruded from the ball house 61.

A very minute gap called a clearance 65 is provided between the ball 50 and the bent part 64, and the clearance 65 provides a passage for the ink 80 when writing is performed.

Then, the ink 80 deposited on the surface of the ball 50 is transferred to the writing surface as the ball 50 rotates, whereby a line is drawn on the writing surface.

(Ink storage Tube 30)

The ink storage tube 30 is approximately formed into a cylindrical shape, in the space of which relatively near to the tip 20 the ink 80 is filled, and in the space of which relatively far from the tip 20 pressuring gas 90 is filled. Moreover, a float 100 traveling through a fixed range according to the decrease of the ink amount is provided between the ink 80 and the pressuring gas 90 in the ink storage tube 30.

Specifically, the ink storage tube 30 is integrally formed by press working using metal material such as stainless or brass.

Moreover, the ink storage tube 30 has a cylindrical large-diameter part 31, a cylindrical intermediate-diameter part 32 smaller in diameter than the large-diameter part 31 formed in connection to an end of the large-diameter part 31, and a cylindrical small-diameter part 33 smaller in diameter than the intermediate-diameter part 32 formed in connection to an end of the intermediate-diameter part 32 opposite to the large-diameter part 31.

Moreover, the ink storage tube 30 has a step-shaped inward step part 34 provided between the large-diameter part 31 and the intermediate-diameter part 32, and a conical throttle part 35 provided between the intermediate-diameter part 32 and the small-diameter part 33.

The large-diameter part 31 is a part for filling the pressuring gas 90 and the ink 80.

Specifically, the pressuring gas 90 is filled in the space of the large-diameter part 31 relatively far from the intermediate-diameter part 32. The ink 80 is filled in the space of the large-diameter part 31 relatively near to the intermediate-diameter part 32. The ink 80 is also filled in the intermediate-diameter part 32 and the small-diameter 33.

Moreover, a tail plug 40 is pressed into an end of large-diameter part 31 opposite to the intermediate-diameter part 32 for preventing the pressuring gas 90 filled in the large-diameter part 31 from leaking out.

Moreover, a diameter reducing part is formed at the end of the large-diameter part 31 opposite to the intermediate-diameter part 32 after the tail plug 40 is pressed into. The diameter reducing part prevents the tail plug 40 pressed into the large-diameter part 31 from dropping out under the pressure of the pressuring gas 90.

Moreover, the float 100 traveling according to the decrease of the ink amount is provided between the ink 80 and the pressuring gas 90 in the large-diameter part 31. The float 100 prevents the ink 80 filled in the space of the large-diameter part 31 relatively near to the intermediate-diameter part 32 from flowing in the direction opposite to the tip 20.

That is, since the large-diameter part 31 is formed to have a relatively large diameter, a capillary force is hard to act within the large-diameter part 31. Consequently, the ink 80 filled in the large-diameter part 31 tends to flow in the direction opposite to the tip 20. Thus, the float 100 approximately formed into a columnar shape is provided between the ink 80 and the pressuring gas 90 in the large-diameter 31, thereby preventing the ink 80 filled in the large diameter part 31 from flowing in the direction opposite to the tip 20.

Moreover, the float 100 provided in the large-diameter part 31 travels toward the intermediate-diameter part 32 according to the decrease of the ink amount, and stops traveling toward the intermediate-diameter part 32 when it abuts against the inward step part 34 provided between the large-diameter part 31 and the intermediate-diameter part 32.

Moreover, the inward step part 34 is apart for connecting the large-diameter part 31 to the intermediate-diameter part 32, and is formed in the shape of a step.

Moreover, the intermediate-diameter part 32 is a part for filling the ink 80, and is formed into a columnar shape smaller in diameter than the large-diameter part 31.

Moreover, the intermediate-diameter part 32 is formed to have a relatively small diameter, and therefore a capillary force easily acts within the intermediate-diameter part 32. Consequently, in the intermediate-diameter part 32, the ink 80 is hard to flow toward the large diameter part 31 even if the float 100 is not provided between the pressuring gas 90 and the ink 80.

Moreover, the throttle part 35 is a part for connecting the intermediate-diameter part 32 to the small-diameter part 33, and is formed into a conical shape.

Moreover, the small-diameter part 33 is a part for fixing the tip 20, and is formed into a cylindrical shape smaller in diameter than the intermediate-diameter part 32.

Moreover, the small-diameter part 33 is formed to have an inner diameter slightly smaller than the outer diameter of the fixing part 68 of the tip 20.

The fixing part 68 of the holder 60 is pressed into the small-diameter part 33, whereby the tip 20 is fixed to the end of the ink storage tube 30.

Moreover, when the fixing part 68 of the holder 60 is pressed into the small-diameter part 33, the end of the small-diameter part 33 opposite to the intermediate-diameter 32 is prevented from abutting against the outward step part 69 of the holder 60, whereby deformation of the small-diameter part 33 is prevented to improve air tightness.

Moreover, the small-diameter part 33 is annealed before the fixing part 68 of the holder 60 is pressed into, thereby preventing stress-corrosion cracking resulting from the fixing part 68 of the holder 60 being pressed into.

Moreover, the small-diameter part 33 is so annealed as to make its hardness preferably 50 to 400 by Vickers' hardness (Hv), more preferably 100 to 200.

By adjusting the hardness of the small-diameter part 33 to fall within the range described above, the fixing part 68 of the holder 60 can easily be pressed into the small-diameter part 33, the small diameter part 33 can become hard to be damaged even if writing is performed under a high load, and the tip 20 can become hard to be detached from the ink storage tube 30 under the pressure of the pressuring gas 90.

If the hardness of the small-diameter part 33 is less than 50 by Vickers' hardness (Hv), the small-diameter part 33 may be damaged when writing is performed under a high load, or the tip 20 may be detached from the ink storage tube 30 under the pressure of the pressuring gas 90.

On the other hand, if the hardness of the small-diameter part 33 is more than 400 by Vickers' hardness (Hv), it becomes difficult to press the fixing part 68 of the holder 60 into the small-diameter part 33.

Moreover, the ink storage tube 30 may be formed using any material that is hard to be deformed, cracked or swelled by reacting with the ink 80, and that is excellent in air tightness and pressure resistance. Therefore the ink storage tube 30 may not be always formed integrally by press working using metal material such as stainless or brass.

Specifically, for example, the ink storage tube 30 may be formed by extrusion molding or injection molding using a plastic material.

Moreover, the ink storage tube 30 may not be always formed integrally.

Specifically, for example, the ink storage tube 30 may be formed in such a manner that an ink storage part for storing the ink 80 and a joint part for coupling the ink storage part with the tip 20 are individually formed, and are then jointed together.

(Ink 80)

The ink 80 is prepared by appropriately blending colorants, solvents, structural viscosity imparting agents, resins, additives and the like.

(Colorants)

For colorants, many of dyes or pigments that have been used in the ink 80 for oil-based ball-point pens may be used.

Specifically, e.g., dyes such as VALIFAST colors (trade name, Orient Chemical Industries, Ltd.), NIGROSINE EX (trade name, Orient Chemical Industries, Ltd.), Eisen Spiron dye, Eisen SOT dye (trade name, Hodogaya Chemical Co., Ltd.), Spiron Violet C-RH (trade name, Hodogaya Chemical Co., Ltd.), Spiron Yellow C-2 GH (trade name, Hodogaya Chemical Co., Ltd.), etc. may be used as colorants.

Moreover, e.g., inorganic pigments such as titanium oxides, carbon black, Carbon Black MA-100 (trade name, Mitsubishi Chemical Co., Ltd.), metal powders, etc. may be used as colorants.

Moreover, e.g., organic pigments such as azo lakes, insoluble azo pigments, chelate azo pigments, phthalocyanine pigments, perylene pigments, anthraquinone pigments, quinacridone pigments, dye lakes, nitro pigments, nitroso pigments, etc. may be used as colorants.

Moreover, each of dyes or pigments described above may be used alone, or two or more of them may be appropriately combined to use.

Moreover, the content of the colorant is preferably 10% to 60% by weight of the total amount of ink 80. If the content of the colorant is less than 10% by weight of the total amount of ink 80, drawn lines look faint, and, on the other hand, if the content of the colorant is more than 60% by weight of the total amount of ink 80, the ink 80 becomes instable with time.

(Solvents)

For solvents, many of organic solvents that have been used in the ink 80 for oil-based ball-point pens may be used.

Specifically, e.g., organic solvents such as ethylene glycol monophenyl ether, benzyl alcohol, phenoxy ethanol, propylene glycol, dipropylene glycol, 1,3-butylene glycol, hexylene glycol, tetralin, propylene glycolmonophenyl ether, dipropylene glycol monomethyl ether, dipropylene glycol monobutyl ether, dipropylene glycol monomethyl ether acetate, tripropylene glycol monomethyl ether, N-methyl-2-pyrrolidone, etc. may be used as solvents.

Moreover, each of these organic solvents may be used alone, or two or more of them may be appropriately combined to use.

Moreover, the content of solvent is preferably 20% to 80% by weight of the total amount of ink 80. If the content of solvent is less than 20% by weight of the total amount of ink 80, a viscosity is increased due to insufficient dissolving power, and, on the other hand, if the content of solvent is more than 80% by weight of the total amount of ink 80, an adequate viscosity is not obtained.

(Structural Viscosity Imparting Agent)

The structural viscosity imparting agent is intended for increasing the viscosity of the ink 80, and imparting a structural viscosity to the ink 80.

The ink 80 added with the structural viscosity imparting agent has a relatively high viscosity under a low shear rate, but has a relatively low viscosity under a high shear rate.

Here, the ink 80 is situated under a low shear rate in the vicinity of the leading end of the tip 20 when writing is not performed. Thus, the ink 80 added with the structural viscosity imparting agent has a relatively high viscosity in the vicinity of the leading end of the tip 20 when writing is not performed. In this way, ink leakage from the leading end of the tip 20 is prevented.

On the other hand, the ink 80 is situated under a high shear rate in the vicinity of the leading end of the tip 20 when writing is performed. Thus, the ink 80 added with the structural viscosity imparting agent has a relatively low viscosity in the vicinity of the leading end of the tip 20 when writing is performed, whereby writing can be performed smoothly.

Specifically, e.g., inorganic fine particles such as carbon black (specifically, e.g., Carbon Black MA-100 (trade name, Mitsubishi Chemical Co., Ltd.)), particulate silica (specifically, e.g., Aerosyl 380 (trade name, Nihon Aerosyl Co., Ltd.), etc. may be used as the structural viscosity imparting agent.

Moreover, each of these inorganic fine particles may be used alone, or two or more of them may be appropriately combined to use.

Moreover, the content of structural viscosity imparting agent is preferably 1% to 20% by weight of the total amount of ink 80, more preferably 5% to 15% by weight of the total amount of ink 80.

By adjusting the content of structural viscosity imparting agent to fall within the range described above, the ink 80 is prevented from leaking from the leading end of the tip 20, and also it is made to possible to perform writing smoothly.

If the content of structural viscosity imparting agent is less than 1% by weight of the total amount of ink 80, the structural viscosity of the ink 80 cannot be sufficiently increased, whereby the ink 80 may leak from the leading end of the tip 20.

On the other hand, if the content of structural viscosity imparting agent is more than 20% by weight of the total amount of ink 80, the structural viscosity of the ink 80 becomes too high, whereby the writability becomes heavy.

(Resins)

Resins are intended for increasing the viscosity of the ink 80, or dispersing a structural viscosity imparting agent in the ink 80.

Specifically, for example, resins such as ketone resins (specifically, e.g., Highrac#111 (trade name, Hitachi Chemical Co., Ltd.)), phenol resins, mallein resins, xylene resins, polyethylene oxide, rosin resins, rosin derivatives, terpene based resins, chroman-indene resins, polyvinyl butyral, polyvinyl pyrrolidone (specifically, e.g., polyvinyl pyrrolidone K-90 (trade name, ISP Co., Ltd.)), vinyl pyrrolidone-vinyl acetate copolymers, polymethacrylates, polyacrylic acid-polymethacrylic acid copolymers, etc. may be used as resins for increasing the viscosity of the ink 80, or dispersing a structural viscosity imparting agent in the ink 80.

Moreover, these resins may be used alone, or two or more of them may be appropriately combined to use.

Moreover, the content of resin is preferably 5% to 80% by weight of the total amount of ink 80, more preferably 25% to 70% by weight of the total amount of ink 80.

By adjusting the content of resin to fall within the range described above, the ink 80 is prevented from leaking from the leading end of the tip, and also it is made to possible to perform writing smoothly.

If the content of resin is less than 5% by weight of the total amount of ink 80, the viscosity of ink 80 cannot be sufficiently increased, whereby the ink 80 may leak from the leading end of the tip 20.

Moreover, if the content of resin is less than 5% by weight of the total amount of ink 80, the viscosity of ink 80 cannot be sufficiently increased and as a result, inorganic fine particles as the structural viscosity imparting agent are not dispersed but precipitated in the ink 80. Consequently, a structural viscosity cannot be imparted to the ink 80 and, as a result, the ink 80 may leak from the leading end of the tip 80 as well.

On the other hand, if the content of resin is more than 80% by weight of the total amount of ink 80, the viscosity of the ink 80 becomes too high, whereby the writability becomes heavy.

(Additives)

For additives, viscosity improvers, stringiness imparting agents, surfactants, dispersants, lubricants, coloring couplers, antibacterial agents, etc. that have been used in the ink 80 for oil-based ball-point pens may be used.

Specifically, for example, oleic acid as a lubricant and a colorant, Highrac#111 (trade name, Hitachi Chemical Co., Ltd.) as a viscosity improver and a dispersant, polyvinyl pyrrolidone K-90 (trade name, ISP Co., Ltd.) as a viscosity improver, a dispersant and a stringiness imparting agent, etc. may be used as additives.

(Process for Manufacturing the Ink 80)

The ink 80 is manufactured by mixing, stirring, etc. the above components.

Specifically, the ink 80 is manufactured through a pigment-dispersing step, an Aerosyl-dispersing step, a dye-dissolving step, a mixing step, a filtration step, etc.

The pigment-dispersing step is a step of dispersing a pigment in a solvent or the like.

In the pigment-dispersing step, Highrac#111 (resin), oleic acid (additive), benzyl alcohol (solvent), phenoxy ethanol (solvent), etc. are first mixed together while they are heated at about 60° C., and then Carbon BlackMA-100 (pigment) is added and stirred using a kneader, a planetary mixer, a roll or the like.

The Aerosyl-dispersing step is a step of dispersing aerosyl in a solvent or the like.

In the Aerosyl-dispersing step, Highrac#111 (resin), polyvinyl pyrrolidone K-90 (resin), benzyl alcohol (solvent), phenoxy ethanol (solvent), etc. are first mixed together while they are heated at about 60° C., and then Aerosyl 380 (structural viscosity imparting agent) is added and stirred using a kneader, a planetary mixer, a roll or the like.

The dye-dissolving step is a step of dissolving a dye in a solvent or the like.

In the dye dissolving step, NIGROSINE EX (dye), Spiron Violet C-RH (dye), Spiron Yellow C-2GH (dye), benzyl alcohol (solvent), phenoxy ethanol (solvent), oleic acid (additive), etc. are stirred while they are heated at about 60° C., whereby these components are dissolved.

The mixing step is a step of mixing the products obtained in the steps described above.

In the mixing step, the product obtained by the pigment-dispersing step, the product obtained by the Aerosyl-dispersing step and the product obtained by the dye-dissolving step are stirred for about 1 hour while they are heated at about 60° C., whereby they are dissolved and mixed.

The filtration step is a step of filtering the product obtained in the mixing step.

Contaminants of the ink 80 are removed by the filtration step.

(Viscosity of the Ink 80)

The ink 80 is adjusted to have a viscosity of 10,000 mPa·s to 50,000 mPa·s at 25° C.

By preparing the ink 80 to have a viscosity of 10,000 mPa·s to 50,000 mPa·s at 25° C., the ink 80 is prevented from leaking from the leading end of the tip 20, and also the writability becomes smooth.

If the viscosity of the ink 80 is less than 10,000 mPa·s at 25° C., the ink 80 may leak from the leading end of the tip 20.

On the other hand, if the viscosity of the ink 80 is more than 50,000 mPa·s at 25° C., the writability becomes heavy.

(Pressuring Gas 90)

The pressuring gas 90 is intended for squeezing the ink 80 filled in the ink storage tube 30 toward the tip 20, and is filled in the space of the large-diameter part 31 of the ink storage tube 30 relatively far from the intermediate-diameter part 32.

(Pressure of the Pressuring Gas 90)

The pressuring gas 90 is adjusted to have an absolute pressure of 0.15 MPa to 0.4 MPa after assembly of the ball-point pen refill 10.

By adjusting the pressuring gas 90 to have an absolute pressure of 0.15 MPa to 0.4 MPa after assembly of the ball-point pen refill 10, the ink 80 is prevented from leaking from the leading end of the tip 20, and also the ink 80 can be used to the end.

If the absolute pressure of the pressuring gas 90 is less than 0.15 MPa after assembly of the ball-point pen refill 10, it may be impossible to use the ink 80 to the end.

On the other hand, if the absolute pressure of the pressuring gas 90 is more than 0.4 MPa after assembly of the ball-point pen refill 10, the ink 80 may leak from the leading end of the tip 20.

(Storage Volume of the Pressuring Gas 90)

Moreover, the storage volume of pressuring gas 90 after assembly of the ball-point pen refill 10 is adjusted to be twice to five times as large as the storage volume of ink 80 after assembly of the ball-point pen refill 10.

That is, the ball-point pen refill 10 is so made that a formula $VA \times 2 \leqq VB \leqq VA \times 5$ (formula 2) is satisfied when VA is the storage volume of ink 80 after assembly of the ball-point pen refill 10, and VB is the storage volume of pressuring gas 90 after assembly of the ball-point pen refill 10.

By making the storage volume of pressuring gas 90 after assembly of the ball-point pen refill 10 twice to five times as large as the storage volume of ink 80 after assembly of the ball-point pen refill 10, the filling amount of ink 80 is made to be as much as possible, and also the pressure of pressuring gas 90 is made to be as low as possible.

That is, the volume of ink storage tube 30 is constant, and, therefore, if the filling amount of ink 80 is increased, then the filling space of the pressuring gas 90 is accordingly decreased. Conversely, if the filling amount of ink 80 is reduced, then the filling space of the pressuring gas 90 is accordingly increased.

Here, for enabling the ink 80 to be used to the end even if the filling amount of ink 80 is increased, the pressure of the pressuring gas 90 should correspondingly be increased. If so, the ink 80 may leak from the leading end of the tip 20.

On the other hand, for keeping the pressure of the pressuring gas 90 at a low level, and also enabling the ink 80 to be used to the end, the filling amount of ink 80 should correspondingly be reduced.

Thus, for maximizing the filling amount of ink 80, and also minimizing the pressure of the pressuring gas 90, it is preferable that the storage volume of pressuring gas 90 after assembly of the ball-point pen refill 10 is adjusted to be twice to five times as large as the storage volume of ink 80 after assembly of the ball-point pen refill 10.

If the storage volume of pressuring gas 90 after assembly of the ball-point pen refill 10 is less than two times as large as the storage volume of ink 80 after assembly of the ball-point pen refill 10, the pressuring gas 90 should be adjusted to have a relatively high pressure for enabling the ink 80 to be used to the end, and consequently the ink 80 may leak from the leading end of the tip 20.

On the other hand, if the storage volume of pressuring gas 90 after assembly of the ball-point pen refill 10 is more than five times as large as the storage volume of ink 80 after assembly of the ball-point pen refill 10, the ink 80 can be used to the end even if the pressure of the pressuring gas 90 is kept at a low level, but the filling amount of ink 80 is correspondingly decreased.

(Composition of the Pressuring Gas 90)

Moreover, the pressuring gas 90 is so prepared that the content of low-reactive gas is 85% or more of the total amount of pressuring gas 90.

Here, for the low-reactive gas, e.g., nitrogen ($N_2$), helium (He), neon (Ne), argon (Ar), krypton (Kr), xenon (Xe), etc. may be used.

Moreover, each of the above gases may be used alone, or two or more of them may be appropriately combined to use.

Nitrogen ($N_2$) is easy to handle and excellent in safety, and is inexpensive, and, therefore, for the low-reactive gas, nitrogen ($N_2$) is, in particular, preferably used.

That is, by including nitrogen ($N_2$) as a main component of the low-reactive gas, assembly and handling of the ball-point pen refill 10 can be made much easier.

The content of the low-reactive gas is made to be 85% or more of the total amount of the pressuring gas 90, whereby the ink 80 can become hard to be deteriorated, and the pressure of the pressuring gas 90 can become hard to decrease.

That is, gas such as oxygen ($O_2$) easily reacts with components of the ink 80. If the gas such as oxygen ($O_2$) reacts with components of the ink 80, the ink 80 is deteriorated. Moreover, if oxygen ($O_2$) or the like reacts with components of the ink 80, not only the ink 80 is deteriorated, but also the amount of the gas such as oxygen ($O_2$) in the pressuring gas 90 decreases. Consequently, the pressure of the pressuring gas 90 correspondingly decreases as the amount of the high-reactive gas such as oxygen ($O_2$) decreases.

In order that the ink 80 becomes hard to be deteriorated, and that the pressure of the pressuring gas 90 becomes hard to decrease, the content of the low-reactive gas is made to be preferably 85% or more of the total amount of the pressuring gas 90, more preferably 90% or more of the total amount of the pressuring gas 90.

If the content of the low-reactive gas is less than 85% of the total amount of the pressuring gas 90, the gas such as oxygen ($O_2$) easily reacts with components of the ink 80 and consequently, the ink 80 tends to be deteriorated, and the pressure of the pressuring gas 90 tends to decrease. Moreover, if the pressure of the pressuring gas 90 significantly decreases, the ink 80 cannot be used to the end in some cases.

(Float 100)

As described previously, the float 100 is intended for preventing the ink 80 filled in the large-diameter part 31 of the ink storage tube 30 from flowing in the direction away from the tip 20.

Specifically, the float 100 is approximately formed into a columnar shape, in one bottom of which is provided an air grove 101 extending to its side, and in another bottom of which is provided a hollow part 102.

Moreover, the float 100 is integrally formed by injection molding using synthetic resin such as polypropylene (PP).

The float 100 is provided in the large-diameter part 31 of the ink storage tube 30 with the bottom provided with the air groove 101 facing the ink 80, and the bottom provided with the hollow part 102 facing the pressuring gas 90.

Moreover, the air groove 101 is intended for preventing an opening of the intermediate-diameter part 32 near to the large-diameter 31 from being clogged when the float 100 abuts against the inward step part 34.

Specifically, the float 100 travels in the large-diameter part 31 toward the intermediate-diameter part 32 according to the decrease of the ink amount, and the float 100 stops traveling toward the intermediate-diameter part 32 when it abuts against the inward step part 34. At this time, the bottom of the float 100 to the ink 80 may clog the opening of the intermediate-diameter part 32 near to the large-diameter 31. Thus, for preventing the opening of the intermediate-diameter part 32 near to the large-diameter 31 from being clogged, the air groove 101 extending to the side of the float 100 is provided on the bottom of the float 100 to the ink 80.

Moreover, the hollow part 102 is intended for preventing the float 100 from sinking in the ink 80.

Specifically, since the float 100 is formed using synthetic resin such as polypropylene (PP), it may sink in the ink 80. Thus, the hollow part 102 is provided on the bottom of the float 100 to the pressuring gas 90, whereby an apparent specific gravity is reduced to prevent the float 100 from sinking in the ink 80.

Moreover, the float 100 is so formed that a formula $0.0005 \leqq (\phi D-\phi C)/\phi C \leqq 0.043$ (formula 3) is satisfied when $\phi C$ is the outer diameter of the float 100, and $\phi D$ is the inner diameter of the large-diameter part of the ink storage tube 30.

For forming the float 100 so that the above formula 3 is satisfied, a predetermined gap is provided between the float 100 and the ink storage tube 30, whereby the float 100 is made to travel smoothly according to the decrease of the ink amount, and the ink 80 is prevented from flowing toward the pressuring gas 90 through the gap between the float 100 and the ink storage tube 30.

If the float 100 is so formed that the formula $0.0005 > (\phi D-\phi C)/\phi C$ is satisfied, the gap between the float 100 and the ink storage tube 30 may be so small that the float 100 cannot travel smoothly according to the decrease of the ink amount.

On the other hand, if the float 100 is so formed that the formula of $(\phi D-\phi C)/\phi C > 0.043$ is satisfied, the gap between the float 100 and the ink storage tube 30 maybe so large that the ink 80 flows toward the pressuring gas 90 through the gap between the float 100 and the ink storage tube 30.

Moreover, the float 100 may be formed using any material that is not deformed, cracked or swelled by reacting with the ink 80, and, therefore, the float 100 may not be always formed using synthetic resin such as polypropylene (PP).

Moreover, the float 100 may be formed in any manner so as to prevent the float 100 from sinking in the ink 80, and, therefore, the float 100 may not be always formed to have the hollow part 102 on its bottom to the pressuring gas 90.

Specifically, for example, the float 100 may be formed using material having a specific gravity smaller than that of the ink 80, thereby preventing the float 100 from sinking in the ink 80.

Moreover, for example, even if the float 100 is formed using material having a specific gravity larger than that of the ink 80, the float 100 can be prevented from sinking in the ink 80 by reducing the apparent specific gravity by providing bubbles inside the float 100.

(Tail Plug 40)

The tail plug 40 is intended for preventing the pressuring gas 90 filled in the ink storage tube 30 leaking out.

The tail plug 40 comprises a metal latch 41, and a rubber seal member 42 provided at an end of the latch 41, and is pressed into an end of the ink storage tube 30 opposite to the tip 20 with the seal member 42 facing to the tip 20.

The tail plug 40 improves air tightness by the rubber seal member 42, and improves pressure resistance by the metal latch 41.

EXAMPLES

The present invention will be described further in detail below with Examples and Comparative Examples.

(Evaluation of Ball-Point Pen Refill 10 (1))

Table 1 described below shows configurations of ball-point pen refills 10 in Examples 1-1 to 1-24 and Comparative Examples 1-1 to 1-31, and evaluations about the initial writing performance, the writable distance and the drop-out of a ball 50 of the ball-point pen refills 10.

Here, the ball-point pen refills 10 shown in Examples 1-1 to 1-24 and Comparative Examples 1-1 to 1-31 were so formed that they were different in the surface roughness (Ra) of the ball 50 and the ratio of the inner diameter of a side part 70 of the ball house 61 to the diameter of the ball 50 ($\phi B/\phi A$).

Moreover, in the ball-point pen refills 10 shown in Examples 1-1 to 1-24 and Comparative Examples 1-1 to 1-31, the ball 50 was made of cemental carbides, the holder 60 was made of stainless, the diameter of the ball 50 was 0.7 mm, the ink 80 having a composition described below was used, the viscosity of the ink 80 was 30,000 mPa·s at 25° C., and the absolute pressure of the pressuring gas 90 after assembly of the ball-point pen refill 10 was 0.3 MPa.

The ink 80 had the following composition:

benzyl alcohol (solvent): 37.4% by weight;

phenoxy ethanol (solvent): 1.5% by weight;

oleic acid (additive): 8.0% by weight;

NIGROSINE EX (colorant): 22.5% by weight;

Spiron Violet C-RH (colorant): 9.0% by weight;

Spiron Yellow C-2GH (colorant): 6.0% by weight;

Carbon Black MA-100 (colorant and structural viscosity imparting agent): 8.0% by weight;

Highrac#111 (resin): 5.4% by weight;

Polyvinyl pyrrolidone K-90 (resin): 0.8% by weight; and

Aerosyl 380 (structural viscosity imparting agent): 1.4% by weight.

Tests of the initial writing performance were conducted in such a manner that it was first checked that writing was possible by hand, and after a lapse of one hour or one day after hand writing was completed, an automatic writing testing machine compliant with ISO Standard 14145-1 was used to carry out testing under the following conditions:

writing speed: 4.5 m/min;

writing angle: 90°; and writing load: 1.96 N.

Evaluations of the initial writing performance were made in such a manner that an average value of the results of the above test conducted for five ball-point pen refills 10 was determined, and the result was rated as follows:

(a) rated as "A" when an average distance between a point at which the test started and a point at which a clear line appeared was 2 mm or less;

(b) rated as "B" when the average distance was 5 mm or less; and (c) rated as "C" when the average distance was 10 mm or less.

(d) The refill was rated as "D" when the average distance was more than 10 mm.

Tests of the writable distance were conducted in such a manner that it was first checked that writing was possible by hand and thereafter, an automatic writing testing machine compliant with ISO Standard 14145-1 was used to carry out testing until writing was no longer possible under the following conditions:

writing speed: 4.5 m/min;

writing angle: 60°; and writing load: 1.96 N.

Evaluations of the writable distance were made in such a manner that an average value of the results of the above test conducted for ten ball-point pen refills 10 was determined, and the result was rated as follows:

(a) rated as "A" when the pen could write until the ink 80 was fully consumed;

(b) rated as "B" when the pen could not write with less than a quarter of the ink filling amount remained; and (c) rated as "C" when the pen could not write with more than a quarter of the ink filling amount remained.

Tests of the ball dropout were conducted by keeping the ball-point refill 10 placed for 100 hours in a thermostatic bath adjusted to have the following conditions:

temperature: 150° C.; and humidity: 30%.

Evaluations of the ball dropout were made in such a manner that the above test was conducted for a hundred ball-point pen refills 10, and the result was rated as follows.

(a) rated as "Good" when no ball-point pen refills 10 among the hundred underwent ball dropout; and (b) rated as "Bad" when one or more ball-point pen refills 10 among the hundred underwent ball dropout.

TABLE 1

| | Ra(μm) | φB/φA | Initial writing performance (1 h) | Initial writing performance (1 d) | Writable distance | Dropout |
|---|---|---|---|---|---|---|
| Comparative Example 1-1 | 0.0060 | 0.997 | D | D | A | Good |
| Comparative Example 1-2 | 0.0060 | 1.003 | D | C | A | Good |
| Comparative Example 1-3 | 0.0060 | 1.011 | C | C | A | Good |
| Comparative Example 1-4 | 0.0060 | 1.014 | C | C | A | Good |
| Comparative Example 1-5 | 0.0060 | 1.017 | C | C | A | Good |
| Comparative Example 1-6 | 0.0060 | 1.029 | C | B | A | Good |
| Comparative Example 1-7 | 0.0060 | 1.043 | B | B | A | Good |
| Comparative Example 1-8 | 0.0060 | 1.057 | B | B | A | Good |
| Comparative Example 1-9 | 0.0060 | 1.071 | B | B | A | Good |
| Comparative Example 1-10 | 0.0060 | 1.110 | B | B | A | Good |
| Comparative Example 1-11 | 0.0060 | 1.129 | B | B | A | Bad |
| Comparative Example 1-12 | 0.0194 | 0.997 | D | C | A | Good |
| Comparative Example 1-13 | 0.0194 | 1.003 | B | C | A | Good |
| Example 1-1 | 0.0194 | 1.011 | A | A | A | Good |
| Example 1-2 | 0.0194 | 1.014 | A | A | A | Good |
| Example 1-3 | 0.0194 | 1.017 | A | A | A | Good |
| Example 1-4 | 0.0194 | 1.029 | A | A | A | Good |
| Example 1-5 | 0.0194 | 1.043 | A | A | A | Good |
| Example 1-6 | 0.0194 | 1.057 | A | A | A | Good |
| Example 1-7 | 0.0194 | 1.071 | A | A | A | Good |
| Example 1-8 | 0.0194 | 1.110 | A | A | A | Good |
| Comparative Example 1-14 | 0.0194 | 1.129 | A | A | A | Bad |
| Comparative Example 1-15 | 0.0360 | 0.997 | C | C | A | Good |
| Comparative Example 1-16 | 0.0360 | 1.003 | B | B | A | Good |
| Example 1-9 | 0.0360 | 1.011 | A | A | A | Good |
| Example 1-10 | 0.0360 | 1.014 | A | A | A | Good |
| Example 1-11 | 0.0360 | 1.017 | A | A | A | Good |
| Example 1-12 | 0.0360 | 1.029 | A | A | A | Good |
| Example 1-13 | 0.0360 | 1.043 | A | A | A | Good |
| Example 1-14 | 0.0360 | 1.057 | A | A | A | Good |
| Example 1-15 | 0.0360 | 1.071 | A | A | A | Good |
| Example 1-16 | 0.0360 | 1.110 | A | A | A | Good |
| Comparative Example 1-17 | 0.0360 | 1.129 | A | A | A | Bad |
| Comparative Example 1-18 | 0.0716 | 0.997 | B | A | A | Good |
| Comparative Example 1-19 | 0.0716 | 1.003 | B | A | A | Good |
| Example 1-17 | 0.0716 | 1.011 | A | A | A | Good |
| Example 1-18 | 0.0716 | 1.014 | A | A | A | Good |
| Example 1-19 | 0.0716 | 1.017 | A | A | A | Good |
| Example 1-20 | 0.0716 | 1.029 | A | A | A | Good |
| Example 1-21 | 0.0716 | 1.043 | A | A | A | Good |
| Example 1-22 | 0.0716 | 1.057 | A | A | A | Good |
| Example 1-23 | 0.0716 | 1.071 | A | A | A | Good |
| Example 1-24 | 0.0716 | 1.110 | A | A | A | Good |
| Comparative Example 1-20 | 0.0716 | 1.129 | A | A | A | Bad |
| Comparative Example 1-21 | 0.0923 | 0.997 | B | A | B | Good |
| Comparative Example 1-22 | 0.0923 | 1.003 | A | A | B | Good |
| Comparative Example 1-23 | 0.0923 | 1.011 | A | A | C | Good |
| Comparative Example 1-24 | 0.0923 | 1.014 | A | A | C | Good |
| Comparative Example 1-25 | 0.0923 | 1.017 | A | A | C | Good |
| Comparative Example 1-26 | 0.0923 | 1.029 | A | A | C | Good |
| Comparative Example 1-27 | 0.0923 | 1.043 | A | A | C | Good |
| Comparative Example 1-28 | 0.0923 | 1.057 | A | A | C | Good |
| Comparative Example 1-29 | 0.0923 | 1.071 | A | A | C | Good |
| Comparative Example 1-30 | 0.0923 | 1.110 | A | A | C | Good |
| Comparative Example 1-31 | 0.0923 | 1.129 | A | A | C | Bad |

In Table 1, "Ra" denotes the surface roughness (Ra) μm of the ball 50, "φB/φ" denotes the ratio of the inner diameter of the side part 70 of the ball house 61 to the diameter of the ball 50, "initial writing performance (1 h)" denotes the evaluation of initial writing performance after a lapse of one hour after writing was completed, "initial writing performance (1 d)" denotes the evaluation of initial writing performance after a lapse of one day after writing was completed, "writable distance" denotes the evaluation of the writable distance, and "dropout" denotes the evaluation of ball dropout.

In this way, the ball-point pen refills 10 in Examples 1-1 to 1-24 were excellent in the initial writing performance, had sufficiently long writable distances, and did not undergo ball dropout.

That is, if the ball-point pen refill 10 is formed as shown in Examples 1-1 to 1-24, the ball-point pen refill 10 is excellent in the initial writing performance, has a sufficiently long writable distance, and its ball 50 is hard to drop out from the ball house 61.

On the other hand, each the ball-point pen refill 10 of Comparative Examples 1-1 to 1-31 had one or more of disadvantages of poor initial writing performance, short writable distance, and likelihood of ball dropout.

That is, if the ball-point pen refill 10 is formed as shown in Comparative Examples 1-1 to 1-31, a ball-point pen refill is made to have one or more of disadvantages of poor initial writing performance, short writable distance, and likelihood of ball dropout.

Moreover, experiments about limit values of the surface roughness (Ra) of the ball 50 were conducted and as a result, it was shown that if, at least, the ball 50 was formed to have a surface roughness (Ra) of 0.010 μm to 0.080 μm, the ball became hard to slip on a writing surface and the ball seat 72 became hard to wear out, and consequently the faint lines became hard to occur, the initial writing performance was improved, and the writing distance was sufficiently increased.

Moreover, it was shown that if the surface roughness (Ra) of the ball 50 is less than 0.010 μm, the ball tended to slip on the writing surface, and consequently the faint lines tended to occur, and the initial writing performance was degraded.

Moreover, it was shown that if the surface roughness (Ra) of the ball 50 is more than 0.080 μm, the ball seat 72 tended to wear out, and consequently the writable distance was decreased.

Moreover, experiments about limit values of the ratio of the inner diameter of the side part 70 of the ball house 61 to the diameter of the ball 50 (ϕB/ϕA) were conducted and as a result, it was shown that if, at least, the side part 70 of the ball house 61 was formed to have an inner diameter equal to 101 to 111% of the diameter of the ball 50, i.e. it was formed to satisfy the requirement of $1.01 \leqq \phi B/\phi A \leqq 1.11$ (formula 1), a sufficient width of passage for the ink 80 could be provided between the ball 50 and the side part 70, whereby the faint lines became hard to occur, the initial writing performance was improved, and the ball 50 became hard to drop out from the ball house 61.

Moreover, it was shown that if the side part 70 of the ball house 61 was formed to have an inner diameter less than 101% of the diameter of the ball 50, i.e. it was formed to satisfy the relation of $1.01 > \phi B/\phi A$, a sufficient width of passage for the ink 80 could not be provided between the ball 50 and the side part 70, and consequently the faint lines tended to occur, and the initial writing performance was degraded.

Moreover, it was shown that if the side part 70 of the ball house 61 was formed to have an inner diameter more than 111% of the diameter of the ball 50, i.e. it was formed to satisfy the relation of $\phi B/\phi A > 1.11$, the ball 50 tended to drop out from the ball house 61.

Moreover, the same test was conducted after changing the composition of the ink 80, the viscosity of the ink 80 and the pressure of the pressuring gas 90, but the results were similar to those of the test described above.

(Evaluation of Ball-Point Pen Refill 10 (2))

Table 2 described below shows the configurations of ball-point pen refills 10 in Examples 2-1 to 2-3 and Comparative Examples 2-1 to 2-3, and evaluations of the ink leakage and the writability of the ball-point pen refills 10.

Here, the ball-point pen refills 10 shown in Examples 2-1 to 2-3 and Comparative Examples 2-1 to 2-3 were so formed that they were different in the composition of the ink 80 and the viscosity of the ink 80.

Moreover, in the ball-point pen refills 10 shown in Examples 2-1 to 2-3 and Comparative Examples 2-1 to 2-3, the ball 50 was made of cemental carbides, the holder 60 was made of stainless, the diameter of the ball 50 was 0.7 mm, the surface roughness (Ra) of the ball 50 was 0.036 μm, the ratio of the inner diameter of the side part 70 of the ball house 61 to the diameter of the ball 50 (ϕB/ϕA) was 1.014, and the absolute pressure of the pressuring gas 90 after assembly of the ball-point pen refill 10 was 0.3 MPa.

Measurements of the viscosity of the ink 80 were carried out using regular cones with an E-type viscometer under the following conditions:

number of revolutions: 1.0 to 2.5 r.p.m.; and temperature: 25° C.

Tests of the ink leakage were conducted by making observations on whether or not the ink 80 was leaked from the leading end of the tip 20 when the pressure of the pressuring gas 90 filled in the ink storage tube 30 was increased to 0.3 MPa.

Evaluations of the ink leakage were rated as follows:

(a) rated as "Good" when the ink 80 was not leaked from the leading end of the tip 20;

(b) rated as "Moderate" when the ink 80 was leaked from the leading end of the tip 20 to form a drop of ink 80 at the leading end of the tip 20, and the diameter of the drop of ink 80 was less than 1 mm; and (c) rated as "Bad" when the ink 80 was leaked from the leading end of the tip 20 to form a drop of ink 80 at the leading end of the tip 20, and the diameter of the drop of ink 80 was 1 mm or more.

Tests of the writability were conducted by writing by hand.

Evaluations of the writability were rated as follows:

(a) rated as "Good" when the writability was smooth;

(b) rated as "Moderate" when the writability was slightly heavy; and (c) rated as "Bad" when the writability was heavy.

TABLE 2

| | Comparative Example 2-1 | Example 2-1 | Example 2-2 | Example 2-3 | Comparative Example 2-2 | Comparative Example 2-3 |
|---|---|---|---|---|---|---|
| BA | 40.4 | 39.4 | 37.4 | 35.4 | 32.4 | 35.3 |
| PG | 1.5 | 1.5 | 1.5 | 1.5 | 1.5 | 1.5 |
| Oleic acid | 8.0 | 8.0 | 8.0 | 8.0 | 8.0 | 8.0 |
| EX | 22.5 | 22.5 | 22.5 | 22.5 | 22.5 | 30.0 |
| C-RH | 9.0 | 9.0 | 9.0 | 9.0 | 9.0 | 9.0 |
| C-2GH | 6.0 | 6.0 | 6.0 | 6.0 | 6.0 | 6.0 |
| MA-100 | 8.0 | 8.0 | 8.0 | 8.0 | 8.0 | 0.0 |
| #111 | 2.4 | 3.4 | 5.4 | 7.4 | 10.4 | 9.4 |
| PVP | 0.8 | 0.8 | 0.8 | 0.8 | 0.8 | 0.8 |
| Aerosyl | 1.4 | 1.4 | 1.4 | 1.4 | 1.4 | 0.0 |
| Total | 100.0 | 100.0 | 100.0 | 100.0 | 100.0 | 100.0 |
| Viscosity | 9,000 | 12,000 | 30,000 | 50,000 | 120,000 | 30,000 |
| Leakage | Moderate | Good | Good | Good | Good | Bad |
| Writability | Good | Good | Good | Good | Bad | Good |

In Table 2, "BA" denotes benzyl alcohol (solvent), "PG" denotes phenoxy ethanol (solvent), "oleic acid" denotes oleic acid (additive), "EX" denotes NIGROSINE EX (colorant), "C-RH" denotes Spiron Violet C-RH (colorant), "C-2G" denotes Spiron Yellow C-2GH (colorant), "MA-100" denotes Carbon Black MA-100 (colorant and structural viscosity imparting agent), "#111" denotes Highrac#111 (resin), "PVP" denotes polyvinyl pyrrolidone K-90 (resin), "Aerosyl" denotes Aerosyl 380 (structural viscosity imparting agent), "viscosity" denotes the viscosity (mPa·s) at 25 C., "leakage" denotes the evaluation of the ink leakage, and "writability" denotes the evaluation of the writability.

In this way, the ball-point pen refills in Examples 2-1 to 2-3 had no the ink leakage, and were smooth in writability.

That is, if the ball-point pen refill 10 is formed as shown in Examples 2-1 to 2-3, a ball-point pen refill 10 having no ink leakage and being smooth in the writability can be produced.

On the other hand, each of the ball-point pen refills 10 in Comparative Examples 2-1 to 2-3 had one or more of disadvantages of likelihood of the ink leakage and bad writability.

That is, if the ball-point pen refill 10 is formed as shown in Comparative Examples 2-1 to 2-3, a ball-point pen refill 10 is made to have one or more of disadvantages of likelihood of the ink leakage and bad writability.

Moreover, experiments about limit values of the viscosity of the ink 80 were conducted and as a result, it was shown that if, at least, the ink 80 is adjusted to have a viscosity of 10,000 mPa·s to 50,000 mPa·s at 25° C., the ink leakage was prevented, and writability became smooth.

Moreover, it was shown that if the viscosity of the ink 80 at 25° C. is less than 10,000 mPa·s, the ink 80 was leaked from the leading end of the tip 20.

Moreover, it was shown that if the viscosity of the ink 80 at 25° C. is more than 50,000 mPa·s, the writability became heavy.

Moreover, it was shown that even if the ink 80 was adjusted to have a viscosity of 10,000 mPa·s to 50,000 mPa·s at 25° C., the ink 80 was leaked from the leading end of the tip 20 unless the structural viscosity imparting agent was added to the ink 80.

(Evaluation of Ball-Point Pen Refill 10 (3))

Table 3 described below shows the configurations of ball-point pen refills 10 in Examples 3-1 and 3-2 and Comparative Examples 3-1 and 3-2, and evaluations about the ink leakage and the writable distance for the ball-point pen refills 10.

Here, the ball-point pen refills 10 shown in Examples 3-1 and 3-2 and Comparative Examples 3-1 and 3-2 were so formed that they were different in the pressure of the pressuring gas 90.

Moreover, in the ball-point pen refills 10 shown in Examples 3-1 and 3-2 and Comparative Examples 3-1 to 3-2, the ball 50 was made of cemental carbides, the holder 60 was made of stainless, the diameter of the ball 50 was 0.7 mm, the surface roughness (Ra) of the ball 50 was 0.036 μm, the ratio of the inner diameter of the side part 70 of the ball house 61 to the diameter of the ball 50 (φB/φA) was 1.014, the ink 80 described in the Evaluation of Ball-Point Pen Refill 10 (1) was used, and the viscosity of the ink 80 at 25° C. was 30,000 mPa·s.

Tests of the ink leakage were conducted by writing five turns of circles having diameters of 5 to 6 cm, then leaving the ball-point pen refill 10 at 25° C. for 1 minute, and observing whether or not the ink 80 is leaked from the leading end of the tip 20.

Evaluations of the ink leakage were rated as follows:

(a) rated as "Good" when the ink 80 was not leaked from the leading end of the tip 20;

(b) rated as "Moderated" when the ink 80 was leaked from the leading end of the tip 20 to form a drop of ink 80 at the leading end of the tip 20, and the diameter of the drop of ink 80 was less than 1 mm; and (c) rated as "Bad" when the ink 80 was leaked from the leading end of the tip 20 to form a drop of ink 80 at the leading end of the tip 20, and the diameter of the drop of ink 80 was 1 mm or more.

Tests of the writable distance were conducted in such a manner that it was first checked that writing was possible by hand and, thereafter, an automatic writing testing machine compliant with ISO Standard 14145-1 was used to carry out testing until writing was no longer possible under the following conditions:

writing speed: 4.5 m/min;

writing angle: 60°; and writing load: 1.96 N.

Evaluations of the writable distance were made in such a manner that an average value of the results of the above test conducted for ten ball-point pen refills 10 was determined, and the result was rated as follows:

(a) rated as "Good" when the average distance until writing was no longer possible was 600 m or more;

(b) rated as "Moderate" when the average distance until writing was no longer possible was 400 m or more and less than 600 m; and (c) rated as "Bad" when the distance until writing was no longer possible was less than 400 m.

TABLE 3

| | Comparative Example 3-1 | Example 3-1 | Example 3-2 | Comparative Example 3-2 |
|---|---|---|---|---|
| Pressure of pressuring gas (MPa) | 0.12 | 0.15 | 0.40 | 0.60 |
| Average of writable distance (m) | 400 | 600 | 600 | 600 |
| Evaluation of writable distance | Moderate | Good | Good | Good |
| Evaluation of leakage of ink | Good | Good | Good | Bad |

In this way, the ball-point pen refills 10 in Examples 3-1 and 3-2 had no ink leakage and had a sufficiently long writable distance.

That is, if the ball-point pen refill 10 is formed as shown in Examples 3-1 and 3-2, a ball-point pen refill 10 having no ink leakage and a sufficiently long writable distance can be produced.

On the other hand, the ball-point pen refills 10 in Comparative Examples 3-1 and 3-2 had one or more of disadvantages of likelihood of the ink leakage occurs and short writable distance.

That is, if the ball-point pen refill 10 is formed as shown in Comparative Examples 3-1 and 3-2, a ball-point pen refill 10 is made to have one or more of disadvantages of likelihood of the ink leakage occurs and short writable distance.

Moreover, experiments about limit values of the pressure of the pressuring gas 90 were conducted and as a result, it was shown that if, at least, the pressuring gas 90 was adjusted to have an absolute pressure of 0.15 MPa to 0.40 MPa, the ink leakage was prevented, and the writable distance became sufficiently long.

Moreover, it was shown that if the absolute pressure of the pressuring gas 90 is less than 0.15 MPa, the ink 80 could not be used to the end, and thus the writable distance became short.

Moreover, it was shown that if the absolute pressure of the pressuring gas 90 was more than 0.40 MPa, the ink 80 was leaked from the leading end of the tip 20.

(Evaluation of Ball-Point Pen Refill 10 (4))

Table 4 described below shows the configurations of ball-point pen refills 10 in Examples 4-1 and 4-2 and Comparative Examples 4-1 and 4-2, and evaluations about the writable distance of the ball-point pen refills 10.

Here, the ball-point pen refills 10 shown in Examples 4-1 and 4-2 and Comparative Examples 4-1 and 4-2 were so formed that they were different in the content of low-reactive gas in the pressuring gas 90.

Moreover, nitrogen ($N_2$) was used as low-reactive gas in the ball-point pen refills 10 shown in Examples 4-1 and 4-2 and Comparative Examples 4-1 and 4-2.

Moreover, in the ball-point pen refills 10 shown in Examples 4-1 and 4-2 and Comparative Examples 4-1 and 4-2, the ball 50 was made of cemental carbides, the holder 60 was made of stainless, the diameter of the ball 50 was 0.7 mm, the surface roughness (Ra) of the ball 50 was 0.036 $\mu$m, the ratio of the inner diameter of the side part 70 of the ball house 61 to the diameter of the ball 50 ($\phi B/\phi A$) was 1.014, the ink 80 described in the Evaluation of Ball-Point Pen Refill 10 (1) was used, the viscosity of the ink 80 at 25° C., was 30,000 mPa·s, and the absolute pressure of the pressuring gas 90 after assembly of the ball-point pen refill 10 was 0.3 MPa.

Tests of the writable distance were conducted in such a manner that the ball-point pen refill 10 was stored under 50° C. for one year after it was assembled, and then an automatic writing testing machine compliant with ISO Standard 14145-1 was used to carry out testing until writing was no longer possible under the following conditions:

writing speed: 4.5 m/min;

writing angle: 60°; and writing load: 1.96 N.

Evaluations of the writable distance were made in such a manner that an average value of the results of the above test conducted for ten ball-point pen refills 10 was determined, and the result was rated as follows:

(a) rated as "Good" when the distance until writing was no longer possible was 600 m or more;

(b) rated as "Moderate" when the distance until writing was no longer possible was 400 m or more and less than 600 m; and (c) rated as "Bad" when the distance until writing was no longer possible was less than 400 m.

TABLE 4

| | Comparative Example 4-1 | Comparative Example 4-2 | Example 4-1 | Example 4-2 |
|---|---|---|---|---|
| Content of low reactive gas (%) | 70 | 80 | 85 | 90 |
| Average of writable distance (m) | 400 | 500 | 600 | 600 |
| Evaluation of writable distance | Moderate | Moderate | Good | Good |

In this way, the ball-point pen refills 10 in Examples 4-1 and 4-2 had a sufficiently long writable distance.

That is, if the ball-point pen refill 10 is formed as shown in Examples 4-1 and 4-2, a drop in pressure of the pressuring gas 90 due to reactions of gas such as oxygen ($O_2$) in the pressuring gas 90 with components of the ink 80 can be prevented, whereby a ball-point pen refill 10 having a sufficiently long writable distance can be produced.

On the other hand, the ball-point pen refills 10 in Comparative Examples 4-1 and 4-2 had a short writable distance.

That is, if the ball-point pen refill 10 is formed as shown in Comparative Examples 4-1 and 4-2, the pressure of the pressuring gas 90 decreases due to reactions of gas such as oxygen ($O_2$) in the pressuring gas 90 with components of the ink 80, whereby a ball-point pen refill 10 is made to have a short writable distance.

Moreover, for low-reactive gas other than nitrogen ($N_2$), same experiments as those described above were conducted and as a result, evaluation results similar to those described above were obtained.

Moreover, experiments about limit values of the content of low-reactive gas in the pressuring gas 90 were conducted and as a result, it was shown that if, at least, the content of low-reactive gas in the pressuring gas 90 was 85% or more, a drop in pressure of the pressuring gas 90 due to reactions of gas such as oxygen ($O_2$) in the pressuring gas 90 with components of the ink 80 could be sufficiently inhibited, whereby the writable distance was sufficiently increased.

Moreover, it was shown that if the content of low-reactive gas in the pressuring gas was less than 85%, the pressure of the pressuring gas 90 decreased due to reactions of gas such as oxygen ($O_2$) in the pressuring gas 90 with components of the ink 80, whereby the writable distance was decreased.

(Evaluation of Ball-Point Pen Refill 10 (5))

Table 5 described below shows the configurations of ball-point pen refills 10 in Examples 5-1 and 5-2 and Comparative Examples 5-1 and 5-2, and evaluations about outflow of the ink 80 of the ball-point pen refills 10.

The ball-point pen refills 10 shown in Examples 5-1 and 5-2 and Comparative Examples 5-1 and 5-2 were so formed that they were different in a value of $(\phi D-\phi C)/\phi C$ when $\phi C$ is the outer diameter of the float 100 and $\phi D$ is the inner diameter of the large-diameter part 31 of the ink storage tube 30.

Moreover, in the ball-point pen refills 10 shown in Examples 5-1 and 5-2 and Comparative Examples 5-1 and 5-2, the ball 50 was made of cemental carbides, the holder 60 was made of stainless, the diameter of the ball was 0.7 mm, the surface roughness (Ra) of the ball 50 was 0.036 μm, the ratio of the inner diameter of the side part 70 of the ball house 61 to the diameter of the ball 50 (φB/φA) was 1.014, polypropylene (PP) was used for the material of the float 100, the ink 80 described in the Evaluation of Ball-Point Pen Refill 10 (1) was used, the viscosity of the ink at 25° C. was 30,000 mPa·s, and the absolute pressure of the pressuring gas 90 after assembly of the ball-point pen refill 10 was 0.3 MPa.

Tests of the outflow of the ink 80 were conducted in such a manner that an automatic writing testing machine compliant with ISO Standard 14145-1 to perform writing over a distance of 200 m under the following conditions:

writing speed: 4.5 m/min;

writing angle: 60°; and writing load: 1.96 N, and then the ball-point pen refill 10 was stored under 25° C. for 3 days with the tip 20 turned upward, followed by observing whether or not the ink 80 flowed toward the pressuring gas 90 through a gap between the float 100 and the ink storage tube 30.

Evaluations of the outflow of the ink 80 were made in such a manner that the above test was conducted for ten ball-point pen refills 10, and the result was rated as follows:

(a) rated as "Good" when there were no cases of the ink 80 flowing toward the pressuring gas 90 through the gap between the float 100 and the ink storage tube 30; and (b) rated as "Bad" when there were one or more cases of the ink 80 flowing toward the pressuring gas 90 through the gap between the float 100 and the ink storage tube 30.

TABLE 5

| | Example 5-1 | Example 5-2 | Comparative Example 5-1 | Comparative Example 5-2 |
|---|---|---|---|---|
| (φD-φC)/φC | 0.020 | 0.040 | 0.045 | 0.060 |
| Outflow of ink (number of cases) | 0 | 0 | 1 | 3 |
| Evaluation of outflow of ink | Good | Good | Bad | Bad |

In this way, for the ball-point pen refills 10 in Examples 5-1 and 5-2, there were no cases of the ink flowing toward the pressuring gas 90 through the gap between the float 100 and the ink storage tube 30.

That is, if the ball-point pen refill 10 is formed as shown in Examples 5-1 and 5-2, a ball-point pen refill 10 in which the ink 80 is prevented from flowing toward the pressuring gas 90 through the gap between float 100 and the ink storage tube 30 can be produced.

On the other hand, the ball-point pen refills 10 in Comparative Examples 5-1 and 5-2 had a disadvantage that the ink 80 tended to flow toward the pressuring gas 90 through the gap between the float 100 and the ink storage tube 30.

That is, if the ball-point pen refill 10 is formed as shown in Comparative Examples 5-1 and 5-2, a ball-point pen refill 10 in which the ink 80 tends to flow toward the pressuring gas 90 through the gap between the float 100 and the ink storage tube 30 will be produced.

Moreover, experiments about limit values of the value of (φD−φC)/φC were conducted and as a result, it was shown that if, at least, the formula $0.0005 \leqq (\phi D-\phi C)/\phi C \leqq 0.043$ (formula 3) was satisfied, the ink 80 became hard to flow toward the pressuring gas 90 through the gap between the float 100 and the ink storage tube 30.

Moreover, it was shown that if the formula $0.0005 > (\phi D-\phi C)/\phi C$ was satisfied, the gap between the float 100 and the ink storage tube 30 became so narrow that the float 100 could not travel smoothly according to the decrease of the ink amount.

On the other hand, it was shown that if the formula $(\phi D-\phi C)/\phi C > 0.043$ was satisfied, the ink 80 tended to flow toward the pressuring gas 90 through the gap between the float 100 and the ink storage tube 30.

Moreover, the present invention should not be limited to Examples described above.

INDUSTRIAL APPLICABILITY

As described above, according to the present invention, a ball-point pen refill in which ink is hard to leak from the leading end of a tip, a ball is hard to drop out from a ball house, faint lines are hard to occur, an excellent initial writing performance is provided, and a writable distance is increased sufficiently can be provided.

Moreover, according to the present invention, a ball-point pen refill in which ink is harder to leak from the leading end of a tip, and writability is smooth can be provided.

Moreover, according to the present invention, a ball-point pen refill in which ink is harder to leak from the leading end of a tip, a ball is harder to drop out from a ball house, faint lines are harder to occur, a further excellent initial writing performance is provided, and the ink can be used to the end can be provided.

Moreover, according to the present invention, a ball-point pen refill in which ink is harder to leak from the leading end of a tip, faint lines are harder to occur, a further excellent initial writing performance is provided, and a writable distance is increased sufficiently can be provided.

Moreover, according to the present invention, a structural viscosity can be imparted to ink, thus making it possible to provide a ball-point pen refill in which the ink is harder to leak from the leading end of a tip, and writability is smooth.

Moreover, according to the present invention, a drop in pressure of a pressuring gas can be prevented, thus making it possible to provide a ball-point pen refill in which faint lines are harder to occur, a further excellent initial writing performance is provided, and a writable distance is increased sufficiently.

Moreover, according to the present invention, a ball-point pen refill that can be easily handled can be provided.

Moreover, according to the present invention, a ball-point pen refill in which faint lines are harder to occur, a further excellent initial writing performance is provided, a writable distance is increased sufficiently, a tip is hard to be detached from an ink storage tube, and the tip can be easily fixed to the ink storage tube can be provided.

Moreover, according to the present invention applied herein, a ball-point pen refill in which ink is hard to flow toward the pressuring gas through a gap between a float and an ink storage tube, and the float can travel smoothly according to the decrease of the ink amount can be provided.

Moreover, according to the present invention, a ball-point pen refill in which ink is harder to flow toward the pressuring gas through a gap between a float and an ink storage tube can be provided.

What is claimed is:

1. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

the tip comprising a ball and a holder for holding the ball;

the ball being formed to have a surface roughness (Ra) of 0.010 $\mu$m to 0.080 $\mu$m;

the holder having a ball house for housing the ball provided in the vicinity of its end opposite to the ink storage tube, and an ink guiding hole extending from its end opposite to the ball house to the ball house for supplying the ink;

the ball house having a cylindrical side part and a conical bottom part decreasing its inner diameter in the direction toward the ink guiding hole; and a formula $1.01 \leqq \phi B/\phi A \leqq 1.11$ being satisfied when $\phi A$ is a diameter of the ball and $\phi B$ is an inner diameter of the side part.

2. The ball-point pen refill according to claim 1, wherein the ink is formulated to have a viscosity of 10,000 mPa·s to 50,000 mPa·s at 25° C.

3. The ball-point pen refill according to claim 2, wherein the ink includes a structural viscosity imparting agent.

4. The ball-point pen refill according to claim 2, wherein the pressuring gas is set to have an absolute pressure of 0.15 MPa to 0.4 MPa after assembly thereof.

5. The ball-point pen refill according to claim 1, wherein the ink includes a structural viscosity imparting agent.

6. The ball-point pen refill according to claim 5, wherein the pressuring gas is set to have an absolute pressure of 0.15 MPa to 0.4 MPa after assembly thereof.

7. The ball-point pen refill according to claim 1, wherein the pressuring gas is set to have an absolute pressure of 0.15 MPa to 0.4 MPa after assembly thereof.

8. The ball-point pen refill according to claim 1, wherein a formula $VA \times 2 \leqq VB \leqq VA \times 5$ is satisfied when VA is a storage volume of the ink after assembly thereof and VB is a storage volume of the pressuring gas after assembly thereof.

9. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

the tip comprising a ball and a holder for holding the ball;

the ball being formed to have a surface roughness (Ra) of 0.010 $\mu$m to 0.080 $\mu$m;

the holder having a ball house for housing the ball provided in the vicinity of its end opposite to the ink storage tube, and an ink guiding hole extending from its end opposite to the ball house to the ball house for supplying the ink;

the ball house having a cylindrical side part and a conical bottom part decreasing its inner diameter in the direction toward the ink guiding hole;

a formula $1.01 \leqq \phi B/\phi A \leqq 1.11$ being satisfied when $\phi A$ is a diameter of the ball and $\phi B$ is an inner diameter of the side part;

the ink being formulated to have a viscosity of 10,000 mPa·s to 50,000 mPa·s at 25° C.;

the ink including a structural viscosity imparting agent; and the pressuring gas being set to have an absolute pressure of 0.15 MPa to 0.4 MPa after assembly thereof.

10. The ball-point pen refill according to claim 9, wherein a formula VA×2 VB VA×5 is satisfied when VA is a storage volume of the ink after assembly thereof and VB is a storage volume of the pressuring gas after assembly thereof.

11. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

the ink being formulated to have a viscosity of 10,000 mPa·s to 50,000 mPa·s at 25° C.;

the pressuring gas being set to have an absolute pressure of 0.15 MPa to 0.4 MPa after assembly thereof.

12. The ball-point pen refill according to claim 11, wherein a formula $VA \times 2 \leqq VB \leqq VA \times 5$ is satisfied when VA is a storage volume of the ink after assembly thereof and VB is a storage volume of the pressuring gas after assembly thereof.

13. The ball-point pen refill according to claim 12, wherein the ink includes a structural viscosity imparting agent.

14. The ball-point pen refill according to claim 13, wherein the pressuring gas includes 85% of low-reactive gas or more in the total amount thereof.

15. The ball-point pen refill according to claim 14, wherein the low-reactive gas includes nitrogen ($N_2$) as a main component.

16. The ball-point pen refill according to claim 15, wherein the ink storage tube is integrally formed using metal material, an end of the tip opposite to the ball is fixed to an end of the ink storage tube by being pressed into the end of the ink storage tube, and a portion around the end of the ink storage tube near to the tip is annealed to be adjusted to have a hardness of 50 to 400 by Vickers' hardness (Hv).

17. The ball-point pen refill according to claim 12, wherein the pressuring gas includes 85% of low-reactive gas or more in the total amount thereof.

18. The ball-point pen refill according to claim 17, wherein the low-reactive gas includes nitrogen ($N_2$) as a main component.

19. The ball-point pen refill according to claim 11, wherein the ink includes a structural viscosity imparting agent.

20. The ball-point pen refill according to claim 19, wherein the pressuring gas includes 85% of low-reactive gas or more in the total amount thereof.

21. The ball-point pen refill according to claim 20, wherein the low-reactive gas includes nitrogen ($N_2$) as a main component.

22. The ball-point pen refill according to claim 11, wherein the pressuring gas includes 85% of low-reactive gas or more in the total amount thereof.

23. The ball-point pen refill according to claim 22, wherein the low-reactive gas includes nitrogen ($N_2$) as a main component.

24. The ball-point pen refill according to claim 11, wherein the ink storage tube is integrally formed using metal material, an end of the tip opposite to the ball is fixed to an end of the ink storage tube by being pressed into the end of the ink storage tube, and a portion around the end of the ink storage tube near to the tip is annealed to be adjusted to have a hardness of 50 to 400 by Vickers' hardness (Hv).

25. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

a float which travels through a fixed range according to decrease of the ink amount being provided between the ink and the pressuring gas in the ink storage tube; and a formula of $0.0005 \leqq (\phi D - \phi C)/\phi C \leqq 0.043$ is satisfied when $\phi C$ is an outer diameter of the float and $\phi D$ is an inner diameter of the ink storage tube in the range where the float travels.

26. The ball-point pen refill according to claim 25, wherein the ink is formulated to have a viscosity of 10,000 mPa·s to 50,000 mPa·s at 25° C.

27. The ball-point pen refill according to claim 26, wherein the ink includes a structural viscosity imparting agent.

28. The ball-point pen refill according to claim 25, wherein the ink includes a structural viscosity imparting agent.

29. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas; and the tail plug comprising a metal latch, and a rubber seal member provided at an end of the latch nearer to the tip.

30. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

the tip comprising a ball and a holder for holding the ball;

the holder comprising the ball house for housing the ball, the bent part for preventing the ball housed in the ball house from dropping out, a conical tapered part gradually increasing its outer diameter in the direction opposite to the bent part, a cylindrical body part provided in connection to an end of the tapered part opposite to the bent part, a cylindrical fixing part smaller in diameter than the body part provided in connection to an end of the body part opposite to the tapered part and pressed into an end of the ink storage tube near to the tip, and a step-shaped outward step part provided between the body part and the fixing part; and the end of the ink storage tube near to the tip being prevented from abutting against the outward step part.

31. A ball-point pen refill comprising an ink storage tube, a tip fixed to an end of the ink storage tube, and a tail plug fixed at an end of the ink storage tube opposite to the tip;

ink being filled in the space of the ink storage tube relatively near to the tip;

pressuring gas being filled in the space of the ink storage tube relatively far from the tip;

the ink being squeezed to flow toward the tip under the pressure of the pressuring gas;

a float traveling through a fixed range according to the decrease of the ink amount is provided between the ink and the pressuring gas in the ink storage tube;

an inward step part inwardly decreasing its diameter being formed in the ink storage tube at an end of the fixed range through which the float can travel near to the tip in the ink storage tube; and an air groove extending to a side of the float being provided in a bottom face of the float nearer to the tip.

* * * * *